US007113159B2

(12) United States Patent
Sawabe

(10) Patent No.: US 7,113,159 B2
(45) Date of Patent: Sep. 26, 2006

(54) LIQUID CRYSTAL DISPLAY DEVICE

(75) Inventor: Daiichi Sawabe, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 305 days.

(21) Appl. No.: 10/334,728

(22) Filed: Jan. 2, 2003

(65) Prior Publication Data

US 2003/0146893 A1 Aug. 7, 2003

(30) Foreign Application Priority Data

Jan. 30, 2002 (JP) ..... 2002-022507
Sep. 9, 2002 (JP) ..... 2002-263235

(51) Int. Cl.
*G09G 3/36* (2006.01)
*G09G 3/34* (2006.01)
*G09G 5/10* (2006.01)

(52) U.S. Cl. ..... 345/89; 345/84; 345/77; 345/690

(58) Field of Classification Search ..... 345/89, 345/690, 63, 77
See application file for complete search history.

(56) References Cited

U.S. PATENT DOCUMENTS 5,847,688 A 12/1998 Ohi et al.
6,801,220 B1 * 10/2004 Greier et al. ..... 345/690
2002/0003598 A1 * 1/2002 Steffensmeier et al. ..... 349/129

FOREIGN PATENT DOCUMENTS

EP 0614107 A1 * 9/1994
JP 2001-147673 5/2001

OTHER PUBLICATIONS

Dictionary of Digital Media, http://www.hansenmedia.com/dict_r.asp?letter-g&ID-1436, 1994-2000, Hansen Media Corp.*
Korean Office Action mailed Apr. 28, 2005 (w/English translation thereof).

* cited by examiner

*Primary Examiner*—Kee M. Tung
*Assistant Examiner*—Chante Harrison
(74) *Attorney, Agent, or Firm*—Nixon & Vanderhye P.C.

(57) ABSTRACT

A liquid crystal display device including a liquid crystal panel being capable of gradation display is provided with a LUT and a drive signal generation section for adjusting gradation curve's distortion with respect to a viewing angle, which indicates a relation between a gradation and a luminance ratio on a display screen of the liquid crystal panel. With this arrangement, it is possible to freely switch on the display screen of the liquid crystal panel between a wide viewing angle display and a narrow viewing angle display. Therefore, it is possible to provide a liquid crystal display device which adjusts the gradation curve's distortion with respect to the viewing angle on the display screen to obtain a high contrast and an excellent gradation curve in a wide range of viewing angle, thereby improving a display quality level of a display screen; and which realizes a display screen with a narrow viewing angle, thereby allowing information not desired to be seen by other people to be securely displayed thereon.

17 Claims, 33 Drawing Sheets

USUAL
ORIENTATION

DIVIDED
ORIENTATION

FROM THE SIDE

FROM ABOVE

FIG. 38

| | | | | |
|---|---|---|---|---|
| $R_{11A}$ BRIGHT+ | $G_{11A}$ DARK+ | $B_{11A}$ BRIGHT+ | $R_{12A}$ DARK+ | ..... |
| $R_{11B}$ DARK− | $G_{11B}$ BRIGHT− | $B_{11B}$ DARK− | $R_{12B}$ BRIGHT− | ..... |
| $R_{21A}$ BRIGHT+ | $G_{21A}$ DARK+ | $B_{21A}$ BRIGHT+ | $R_{22A}$ DARK+ | ..... |

FIG. 39

| | | | | |
|---|---|---|---|---|
| $R_{11A}$ DARK− | $G_{11A}$ BRIGHT− | $B_{11A}$ DARK− | $R_{12A}$ BRIGHT− | ..... |
| $R_{11B}$ BRIGHT+ | $G_{11B}$ DARK+ | $B_{11B}$ BRIGHT+ | $R_{12B}$ DARK+ | ..... |
| $R_{21A}$ DARK− | $G_{21A}$ BRIGHT− | $B_{21A}$ DARK− | $R_{22A}$ BRIGHT− | ..... |

LIQUID CRYSTAL DISPLAY DEVICE

FIELD OF THE INVENTION

The present invention relates to a liquid crystal display device being capable of gradation display.

BACKGROUND OF THE INVENTION

Generally, an active matrix type liquid crystal display device has a structure of a pair of glass substrates opposed and fixed which between a liquid crystal is filled in a space. More specifically, transparent common electrodes are provided on one glass substrate, a large number of transparent pixel electrodes are provided in a matrix manner on the other glass substrate, and a circuit for individualistically applying voltages to the pixel electrodes.

The liquid crystal display device performs display operation with sandwiched polarizing plates in the foregoing structure, so that it has a characteristic of a narrow viewing angle.

To increase a viewing angle, have been proposed liquid crystal display devices utilizing IPS (In Plane Switching), MVA (Multi domain Vertical Aline), or ASV (Advance Super View) mode as a physical technique such as divided orientation.

Here, the following will explain a typical technique for increasing a viewing angle.

First, referring to FIG. 27, TN (Twisted Nematic) mode will be explained as follows. In FIG. 27, bold and black lines represent crystal elements.

FIG. 27 shows the movement of the liquid crystal elements in the TN mode. When no voltage is applied (voltage is OFF), the liquid crystal elements are oriented as shown on the left in the drawing. As a voltage is applied, the liquid crystal elements are caused to stand as shown in the middle of the drawing. When a maximum voltage is applied, the liquid crystal elements are oriented as shown on the right in the drawing. Each gradation level is expressed by change in applied voltages.

In the foregoing TN mode, the liquid crystal elements are oriented obliquely and a viewing angle characteristic occurs depending on the oriented direction. Here, the occurrence of the viewing angle characteristic means the state in which display image cannot appear normally depending on the angle at which a display screen is viewed.

Such a viewing angle characteristic occurs because the liquid crystal elements have a bar shape and a polarization characteristic. More specifically, when a voltage is applied, the liquid crystal elements, each of which has the same characteristic, move in the same direction. This causes the viewing angle characteristic with respect to the leaning angles of the liquid crystal elements.

Conventionally, to reduce the effects by the polarization characteristic of the liquid crystal, an orientation dividing method is adopted as shown in FIGS. 28(*a*) and 28(*b*). Unlike the usual orientation, the method reduces the polarization characteristic by dividing the orientation of pixels in the different orientation directions so as to disperse the orientation directions of the liquid crystal.

This orientation dividing method does not cause the viewing angle characteristic of the liquid crystal elements in the TN mode, so that it is possible to realize the increased viewing angle.

Secondly, referring to FIGS. 29(*a*) and 29(*b*), the IPS (In Plane Switching) mode will be explained as follows.

In the IPS mode, as shown in FIG. 29(*a*), the longitudinal direction of the liquid crystal elements is in parallel to the panel plane, so that although the IPS mode has a low dependency on a physical viewing angle, it has a wavelength dependency on light that transmits the liquid crystal element, and the amount of this wavelength dependency causes change in the viewing angle. Also, human eyes have a wavelength characteristic, so that the wavelength dependency changes in luminance on the display screen. This causes the problem of a narrow viewing angle.

Conventionally, to realize an increased viewing angle, proposed has been a method of dividing the orientation in zigzag so as to cancel the wavelength dependency (super IPS).

Note that, the IPS mode has two major disadvantages:

(1) Response speed is low; and (2) Transmittance is extremely poor.

Next, referring to FIG. 30, the VA (Vertical Alignment) mode will be explained as follows.

In the VA mode, as shown in FIG. 30, when no voltage is applied (OFF), the longitudinal direction of the liquid crystal elements is vertical to the panel plane. When a voltage is applied (ON), the longitudinal direction of the liquid crystal elements is horizontal to the panel plane. Therefore, viewing angle characteristic improves when a voltage is ON and OFF. Incidentally, in a halftone at which a mediate voltage is applied, the liquid crystal elements are oriented obliquely in one direction, which causes the viewing angle characteristic. The viewing angle characteristic in this case is in the same level as that of the TN mode.

Thus, in the VA mode, the viewing angle characteristic occurs in the halftone, which results in the problem of the narrow viewing angle.

Note that, as compared with the IPS mode, the VA mode has the following characteristics:

(1) Response speed is high;

(2) Contrast can be gained because black level is high in quality; and (3) Transmittance is better than that of the IPS mode, although it is worse than that of the TN mode.

To improve the viewing angle characteristic of the halftone in the VA mode, the following MVA (Multi-domain VA) mode has been proposed.

Next, referring to FIGS. 31(*a*) and 31(*b*), the MVA mode will be explained as follows.

The MVA mode is the mode in which the VA mode is subjected to orientation division. Such an orientation division can improve the viewing angle characteristic of the halftone.

More specifically, as shown in FIG. 31(*a*), an object having a structure of a substantially triangular shape on cross section is applied onto the panel plane, and oriented films are further formed thereon. Therefore, as shown in FIG. 31(*b*), because of the foregoing object on the panel plane, the liquid crystal elements lean along the object when a voltage is applied, which produces the effects of divided orientation in the halftone. In such a manner, an increased viewing angle is realized in the VA mode.

Note that, the VA mode can improve the viewing angle characteristic by the divided orientation as described above; however, it does not improve so much as the IPS mode.

Furthermore, unlike the foregoing physical method such as the divided orientation, Japanese Laid-Open Patent Publication No. 121144/1995 (Tokukaihei 7-121144; published on May 12, 1995) (a Japanese equivalent to the U.S. Pat. No. 5,847,688) proposes a liquid crystal display device in which a viewing angle is electrically increased, utilizing a plurality of different gamma characteristics based on an input image signal.

Incidentally, the width of the viewing angle in the liquid crystal display device is defined by the width of the area where a contrast ratio of white to black is not less than a predetermined value. Note that, a gradation curve is also an important element for the accurate reproduction of images. Since the gradation curve does not significantly change depending on the viewing angle in display devices, except for a liquid crystal display device, such as a cathode-ray tube monitor and a plasma monitor, the definition of the width of the viewing angle is usually considered to be no problem.

However, the gradation curve is an important element for the reproduction of images. For example, in a display device of 256 gradation levels, the gradation curve when viewed from the front has:

a luminance ratio=$(n/255)^{2.2}$, and the gradation curve when viewed from the side has:

a luminance ratio=$(n/255)^{1.0}$, where "n" is a gradation.

At this moment, in case of the display of a gray color with gradation level 128, the gradation level 128 is displayed when viewed from the front. On the other hand, a gray color with gradation level 186 is displayed when viewed from the side, and a whitish display is made as compared with when viewed from the front.

Further, in case where the gradations of R, G, B are different, the difference in gradation display is remarkable. For example, when R is at gradation level 0, G is at gradation level 128, and B is at gradation level 255, the luminance ratio of the front is R:G:B=0:0.22:1. On the other hand, the luminance ratio of the side is R:G:B=0:0.50:1, which indicates the change into a strongly green-tinged display.

As described above, even the same original data is changed into different image depending on the change in the gradation curve.

Therefore, in view of a contrast ratio, the liquid crystal display devices utilizing the wide viewing angle modes such as ISP, MVA, and ASV modes realize a wide viewing angle. However, the gradation curve is different when viewed from the side. This means a lack of image reproduction when viewed from the side.

Thus, the difference in the gradation curve between when viewed from the front and from the side is referred to as distortion of gradation curve.

Further, the liquid crystal display device disclosed in the foregoing publication increases the viewing angle by improving the viewing angle characteristic when viewed from the side, using gamma characteristic, so that the gradation curve when viewed from the front distorts. Especially, in case where the viewing angle characteristics at the both sides sandwiching the front deviates in the same direction as that of the target gamma characteristic, it is necessary to largely change the gradation curve when viewed from the front.

This means to bring about the deterioration of the image reproduction when viewed from the front.

As described above, in all of the conventional liquid crystal display devices realizing an increased viewing angle, the gradation curve when viewed from the front is different from that when viewed from the side, in other words, the gradation curve's distortion with respect to the viewing angle occurs in the display image, so that image when viewed from the front is different from that when viewed from the side. As a result, it is impossible to obtain an excellent quality of image in a wide range of viewing angle, which causes the problem of the deterioration in a display quality level.

Further, the conventional liquid crystal display device has a constant range of viewing angle, it is necessary to replace the display deice itself when change in the range of viewing angle is desired as in the case when information desired to be shown to other people is arranged so as to be shown to many other people and the case when information not desired to be shown to other people is arranged so as not to be shown.

SUMMARY OF THE INVENTION

An object of the present invention is to provide a liquid crystal display device which obtains a high contrast and an excellent gradation curve with a wide viewing angle so that a display quality level of a display screen can be improved, as well as which realizes the display screen with a narrow viewing angle to securely display information not desired to be shown to other people, by the adjustment in the gradation curve's distortion with respect to the viewing angle on the display screen.

In order to attain the above object, in the liquid crystal display device of the present invention having a liquid crystal panel being capable of gradation display, included is a distortion adjustment section (distortion adjusting means) for adjusting gradation curve's distortion with respect to a viewing angle, the gradation curve indicating a relation between a gradation and a luminance ratio on a display screen of the liquid crystal panel.

Generally, the width of the viewing angle in the liquid crystal display device is determined by the area where a contrast ratio of white to black is not less than a predetermined value. For accuracy of display, an important element is the gradation curve indicating a relation between a viewing angle and luminance at each gradation level on the display screen.

However, in case of the liquid crystal display device, the gradation curve differs with respect to each viewing angle, which causes the difference in luminance ratio at the same gradation level, depending on the viewing angle. More specifically, in the liquid crystal display device, the gradation curve distorts depending on the viewing angle. Increase in the gradation curve's distortion with respect to the viewing angle increases the difference in appearance of the display screen between when viewed from the front and from the side. This results in the problem of the deterioration in display quality level of an entire display screen. This phenomenon is remarkable in the liquid crystal display device with an increased viewing angle.

Thus, the decrease in the gradation curve's distortion with respect to the viewing angle, i.e. the decrease of the difference in luminance ratio at the same gradation level depending on the viewing angle can decrease the difference in appearance of the display screen between when viewed from the front and from the side. This results in the improvement in the display quality level of the entire display image.

Consequently, it is possible to adjust the difference in appearance of the display screen between the viewing angles by the distortion adjustment section adjusting the gradation curve's distortion with respect to the viewing angle, as the above arrangement.

For example, when the gradation curve's distortion with respect to the viewing angle is adjusted so as to be small by the distortion adjustment section, it is possible to decrease the difference in appearance of the display screen between the viewing angles. More specifically, it is possible to decrease the difference in appearance of the display screen between when viewed from the front and from the side. This can make the appearance of the display image substantially identical between the cases when viewed from the front and from the side, so that it is possible to improve the display quality level in the liquid crystal display device with a wide range of viewing angle (wide viewing angle).

When the gradation curve's distortion with respect to the viewing angle is adjusted so as to be large by the distortion adjustment section, it is possible to increase the difference in appearance of the display screen between the viewing angles. More specifically, it is possible to increase the difference in appearance of the display screen between when viewed from the front and from the side. This can display the screen in a narrow range of viewing angle (narrow viewing angle), so that, for example, it is possible to arrange so that it is easy for human eye to see the display screen from the front and it is difficult to see it from the side, whereby information not desired to be shown to other people can be displayed securely.

As described above, the adjustment in the gradation curve's distortion with respect to the viewing angle can freely switch on the display screen between a wide viewing angle display and a narrow viewing angle display. Therefore, it is possible to display a high display quality level of images with a viewing angle corresponding to the displaying purpose of the liquid crystal display device.

For a fuller understanding of the nature and advantages of the invention, reference should be made to the ensuing detailed description taken in conjunction with the accompanying drawings.

BRIEF DESCRIPTION OF THE DRAWINGS

FIG. 38 is a view showing a polarity pattern of applied voltages in a certain frame on a liquid crystal panel provided in a liquid crystal display device according to yet another embodiment of the present invention.

FIG. 39 is a view showing a polarity pattern of applied voltages in another frame on the liquid crystal panel shown in FIG. 38.

DESCRIPTION OF THE EMBODIMENTS

In the present embodiment, explained is a liquid crystal display device using an ASV mode as mode of a liquid crystal with a wide viewing angle.

[First Embodiment]

Figure 1:
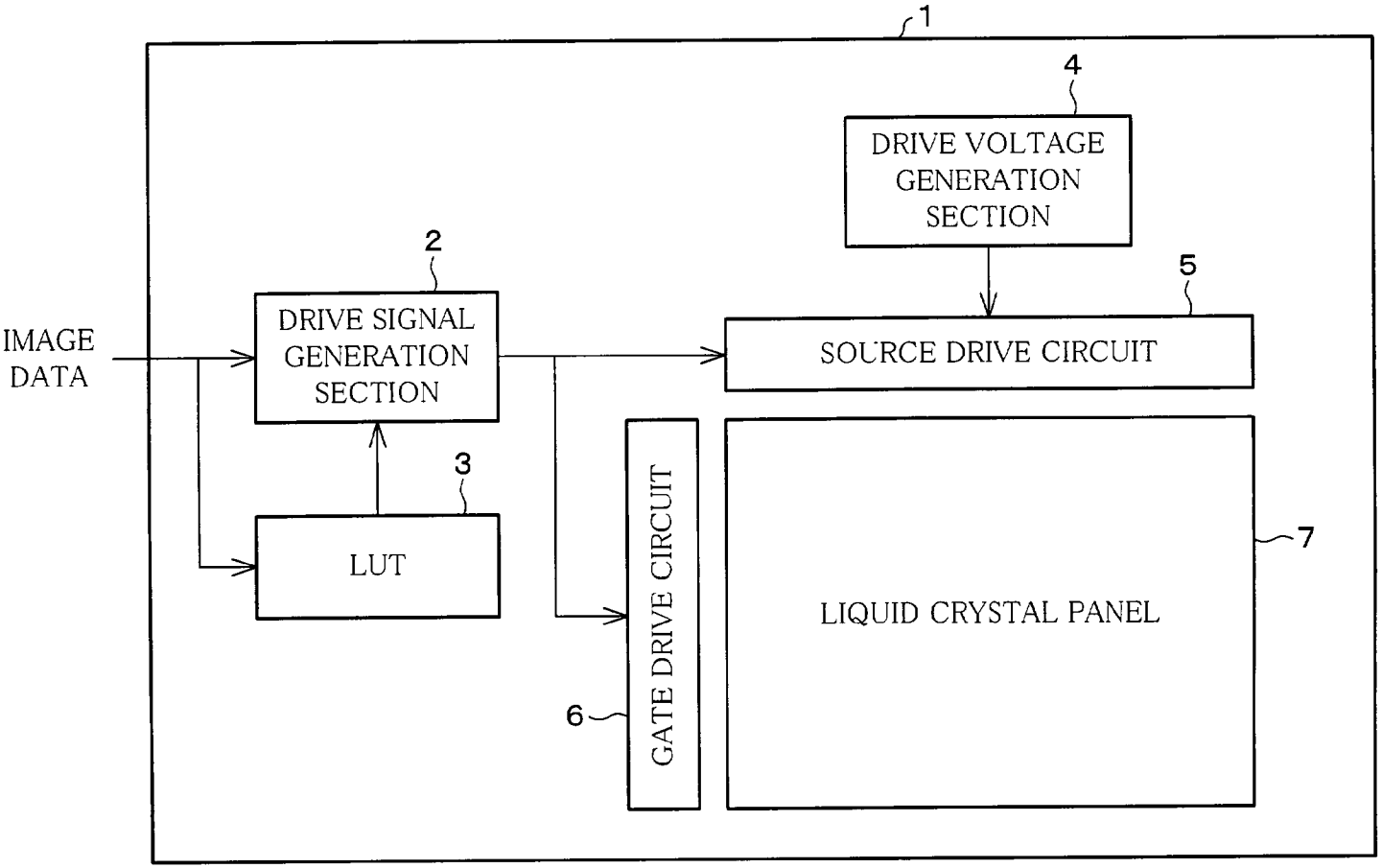
FIG. 1 is a block diagram schematically showing an arrangement of a liquid crystal display device according to the embodiment of the present invention.

As shown in FIG. 1, a liquid crystal display device 1 as a display device according to the present embodiment has an active matrix type arrangement, including a drive signal generation section 2, an LUT (Look-Up Table) 3, a drive voltage generation section 4, a source drive circuit 5, a gate drive circuit 6, a liquid crystal panel (display panel) 7.

The drive signal generation section 2 is a circuit for generating a drive signal for operating the source drive circuit 5 and the gate drive circuit 6, in accordance with image data and a reference result of the LUT 3. The generated signals are outputted to the source drive circuit 5 and the gate drive circuit 6, respectively.

The LUT 3 is a conversion table for converting image data as display data so that gradation properties can be secured in a wide viewing angle, when the image data is displayed on the liquid crystal panel 7. More specifically, the LUT 3 is supplied thereto the same data as the image data supplied to the drive signal generation section 2, and transmits a referred result of the conversion table in accordance with the supplied image data.

Note that, the drive signal generation section 2 and the LUT 3 each include a function of distortion adjusting means for adjusting a gradation curve's distortion as described later. The details will be described later.

The drive voltage generation section 4 is a circuit for generating a drive voltage applied to the liquid crystal panel 7. The drive voltage produced by the drive voltage generation section 4 is transmitted to the source drive circuit 5.

The source drive circuit 5 is a circuit for applying voltages to source bus lines (not shown) arranged vertically to the liquid crystal panel 7, in order to drive the liquid crystal panel 7 in accordance with the signal transmitted from the drive signal generation section 2 and the drive voltage generated by the drive voltage generation section 4. More specifically, the source bus line is applied thereto the voltage based on the signal transmitted from the drive signal generation section 2.

The gate drive circuit 6 is a circuit for applying a voltage for an active matrix drive to the gate bus lines arranged horizontally to the liquid crystal panel 7, in order to drive the liquid crystal panel 7 in accordance with the signal transmitted from the drive signal generation section 2. More specifically, the gate bus line is selectively applied thereto the voltage in accordance with the signal transmitted from the drive signal generation section 2.

The liquid crystal panel 7, which is an active matrix type display panel having a plurality of pixels arranged in a matrix manner, operates in response to the application of the voltage to the source bus line and the gate bus line by the source drive circuit 5 and the gate drive circuit 6, respectively, and displays image in accordance with the image data supplied.

Figure 2:
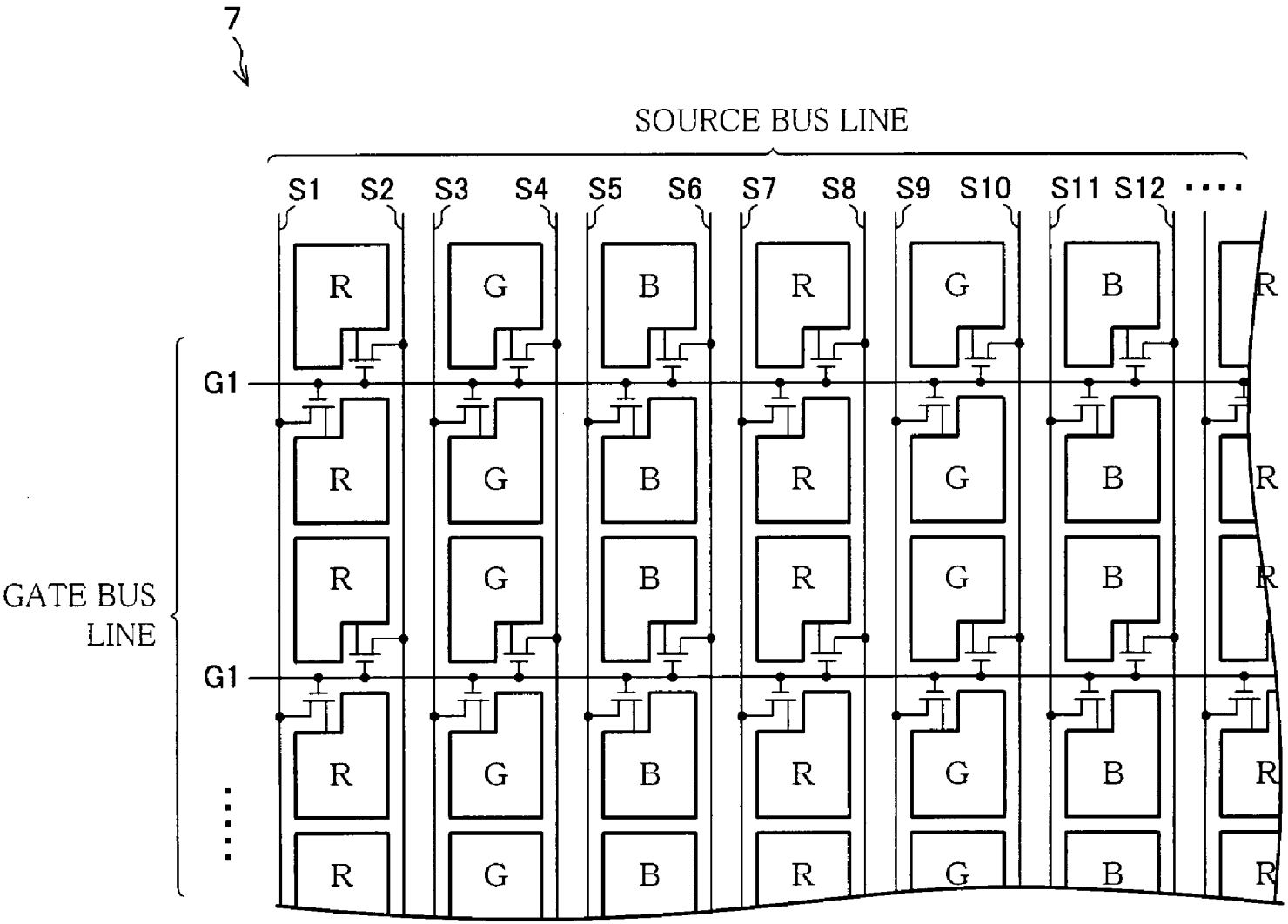
FIG. 2 is a plane view showing a main part of a liquid crystal panel provided in the liquid crystal display device shown in FIG. 1.

The liquid crystal panel 7, as shown in FIG. 2, has a structure in which source bus lines S1, S2, S3 . . . arranged in the vertical direction are perpendicular to gate bus lines G1, G2, G3 . . . arranged in the horizontal direction, and a pixel electrode and a transistor for driving the pixel electrode are arranged at each intersection point.

Figure 3:
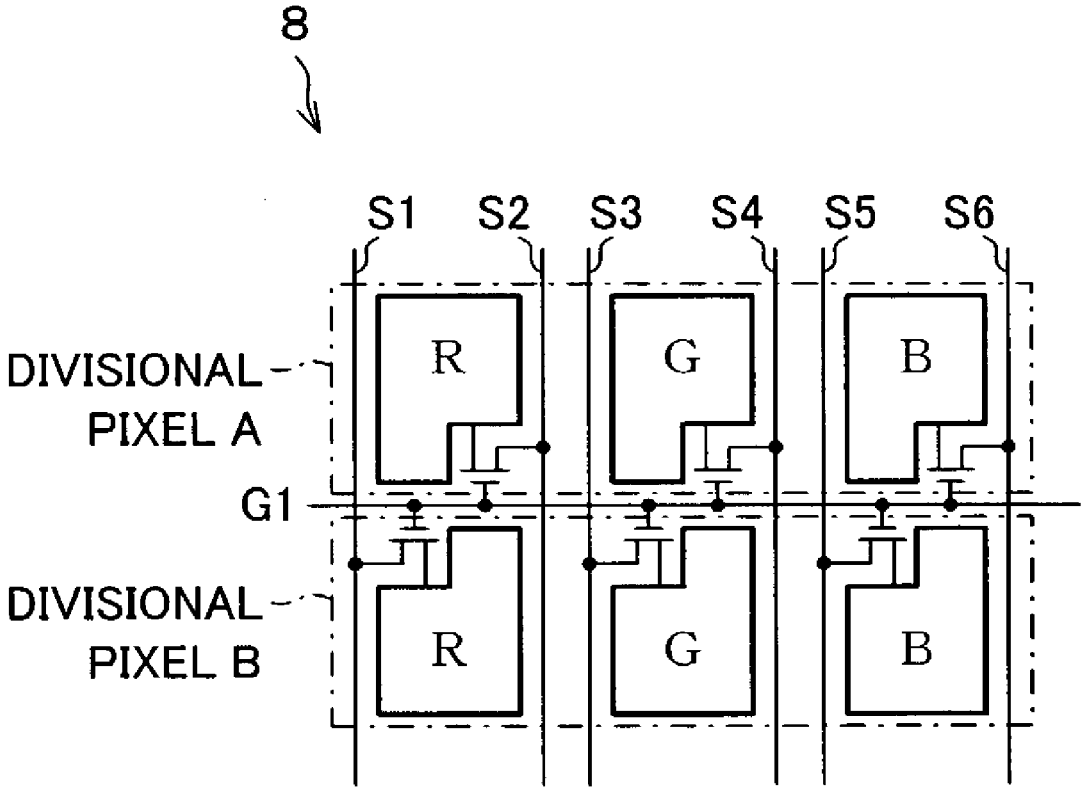
FIG. 3 is a plane view showing a main part of pixels constituting the liquid crystal panel shown in FIG. 2.

In the present embodiment, one gate bus line can apply a drive voltage from the gate drive circuit 6 to pixel electrodes in two lines. More specifically, in the present embodiment, as shown in FIG. 3, one pixel 8 is composed of the pixel electrodes: red (R), green (G), blue (B) each of which are divided into two divisional pixels A and B. These divisional pixels are supplied thereto the drive voltage from the gate drive circuit 6 at the same timing because they are connected to the same gate bus line; however, they are supplied thereto the drive voltage from the source drive circuit 5 at a different timing each divisional pixel because they are connected to source bus lines separately.

Display on the pixel 8 is an average value of the divisional pixels A and B.

Figure 4:
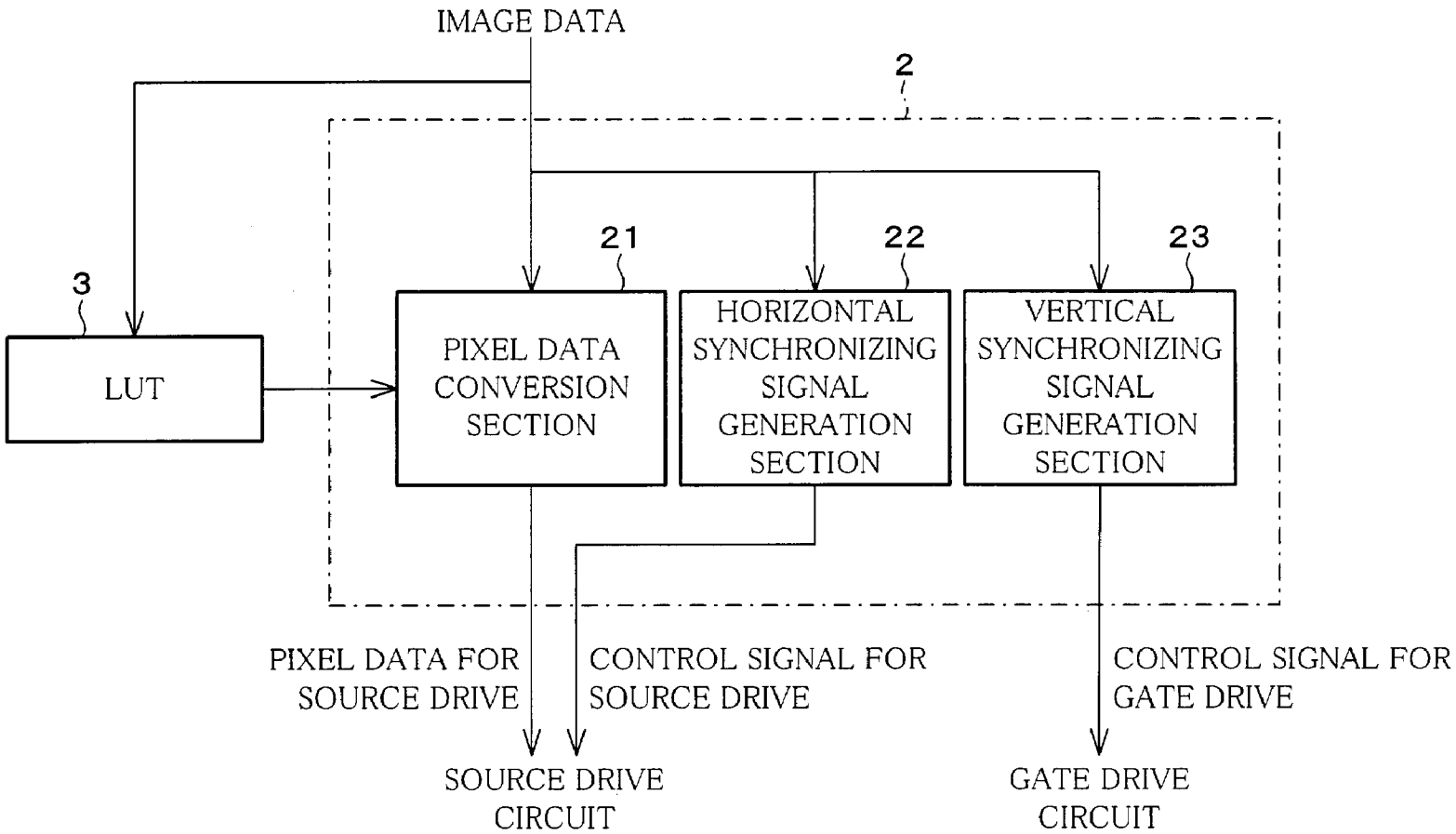
FIG. 4 is a block diagram schematically showing an arrangement of a drive signal generation section provided in the liquid crystal display device shown in FIG. 1.

Here, the following will specifically explain the drive signal generation section 2 with reference to FIG. 4.

The drive signal generation section 2 includes a pixel data conversion section 21, a horizontal synchronizing signal generation section 22, and a vertical synchronizing signal generation section 23.

The pixel data conversion section 21 converts the supplied image data in accordance with the reference result of the LUT 3 and transmits the converted image data as image data for source drive to the source drive circuit 5.

The horizontal synchronizing signal generation section 22 generates a horizontal synchronizing signal in accordance with the supplied image data, and transmits the generated signal (control signal for source drive) to the source drive circuit 5.

The vertical synchronizing signal generation section 23 generates a vertical synchronizing signal in accordance with the supplied image data, and transmits the generated signal (control signal for gate drive) to the gate drive circuit 6.

More specifically, the operation of the drive signal generation section 2 will be explained as follows.

First, original data, which is image data supplied to the liquid crystal display device 1, is:

{R1, G1, B1}, {R2, G2, B2}, {R3, G3, B3}, {R4, G4, B4}, {R5, G5, B5}, . . . , where the parentheses { } indicate a segment of one pixel data, and input data is made from a combination of (R, G, B).

At this time, the data (output data) outputted from the pixel data conversion section 21, which is data (pixel data for source drive) converted from the original data in accordance with the reference result of the LUT 3, e.g. the reference result shown in Table 1, is:

{A(R1) B(R1), A(G1), B(G1), A(B1), B(B1)}, {A(R2), B(R2), A(G2), B(G2), A(B2), B(B2)}, . . .

TABLE 1

| D= | A(D)= | B(D)= |
|---|---|---|
| 0 | 0 | 0 |
| . . . | . . . | . . . |
| 16 | 0 | 3 |
| . . . | . . . | . . . |
| 32 | 0 | 7 |
| . . . | . . . | . . . |
| 48 | 0 | 9 |
| . . . | . . . | . . . |
| 64 | 0 | 27 |
| . . . | . . . | . . . |
| 80 | 0 | 46 |
| . . . | . . . | . . . |
| 96 | 0 | 75 |
| . . . | . . . | . . . |
| 112 | 0 | 118 |
| . . . | . . . | . . . |
| 128 | 0 | 152 |
| . . . | . . . | . . . |
| 144 | 0 | 182 |
| . . . | . . . | . . . |
| 160 | 0 | 210 |
| . . . | . . . | . . . |
| 176 | 0 | 240 |
| . . . | . . . | . . . |
| 192 | 25 | 255 |
| . . . | . . . | . . . |
| 208 | 101 | 255 |
| . . . | . . . | . . . |
| 224 | 197 | 240 |
| . . . | . . . | . . . |
| 240 | 238 | 241 |
| . . . | . . . | . . . |
| 255 | 255 | 255 |

In the present embodiment, as shown in FIG. 3, one pixel 8 is composed of two divisional pixels A and B, so that one pixel data inside the parentheses { } includes six kinds of data. Therefore, the drive signal generation section 2 transmits to the source drive circuit 5, in addition to one pixel data, control signals for source drive, such as a source clock for control of data capture, a source start pulse indicating start of data, a latch pulse controlling the switching of source output, which are control signals generated in the horizontal synchronizing signal generation section 22.

Further, in the drive signal generation section 2, the vertical synchronizing signal generation section 23 generates signals for controlling the gate drive circuit 6 simultaneously. More specifically, the vertical synchronizing signal generation section 23 generates control signals for gate drive, such as a gate clock indicating timing of applied gate bus line's shift and a gate start pulse indicating a start of frame switching; and transmits them to the gate drive circuit 6.

The source drive circuit 5 applies desired voltages to the source bus lines in accordance with pixel data for source drive transmitted from the drive signal generation section 2 and a voltage value transmitted from the drive voltage generation section 4.

For example, in FIG. 3, a voltage required for the display of A(R1)'s gradation is applied to a source bus line S1, a voltage required for the display of B(R1)'s gradation is applied to a source bus line S2, a voltage required for the display of A(G1)'s gradation is applied to a source bus line S3, a voltage required for the display of B(G1)'s gradation is applied to a source bus line S4, a voltage required for the display of A(B1)'s gradation is applied to a source bus line S5, and a voltage required for the display of B(B1)'s gradation is applied to a source bus line S6. Likewise, voltages required for the display of the pixels' gradations are applied to the respective source bus lines.

Figure 5:
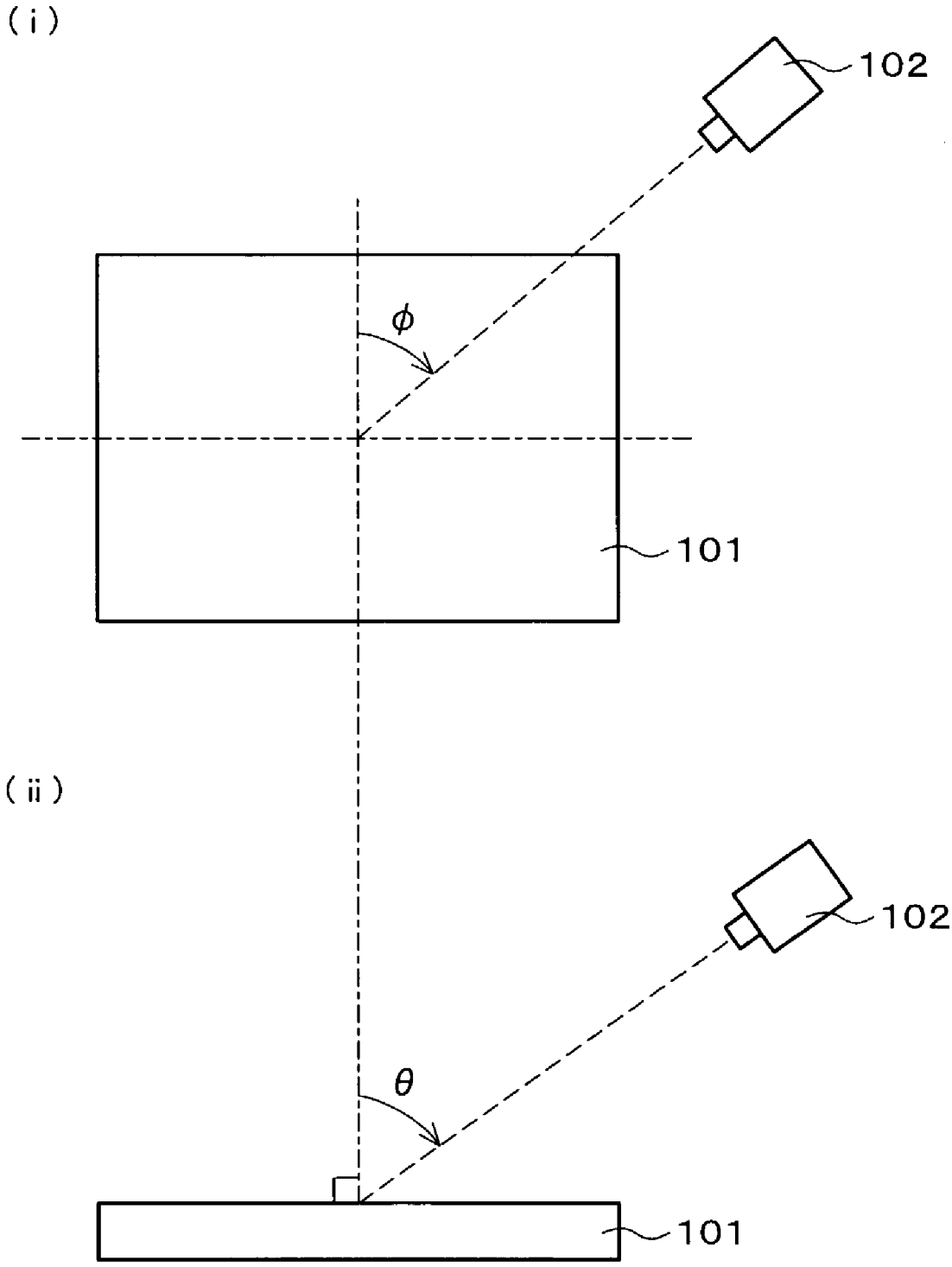
FIG. 5 is an explanatory view of a method for measuring a luminance at each viewing angle with respect to a liquid crystal panel.

The following will explain how to find out a look-up table referred in the LUT 3 with reference to FIG. 5.

First, when the luminance of the azimuth $\phi$, viewing angle $\theta$, and gradation n is $L(\gamma, \phi, \theta, n)$, a target gradation curve of $\Gamma(\gamma, \phi, \theta, n)$ is expressed by the following equation (1).

$$\Gamma(\gamma, \phi, \theta, n) = \left(\frac{n}{255}\right)^{\gamma} * \left(\frac{L(\phi, \theta, 255) - L(\phi, \theta, 0)}{L(\phi, \theta, 255)}\right) + \left(\frac{L(\phi, \theta, 0)}{L(\phi, \theta, 255)}\right) \quad (1)$$

Note that, $\Gamma$ is a numerical value normalized by 1. Also, the gradation curve is usually set to $\gamma=2.2$.

Here, as shown in FIG. 5(*i*), the azimuth $\phi$ indicates an angle rotated by $\phi$ in a clockwise direction, where the upper direction with respect to the display screen of a module 101 is 0°; and the luminance of the display screen on the module 101 is measured from the angle by a luminance measuring apparatus 102.

Further, as shown in FIG. 5(ii), the viewing angle $\theta$ indicates the angle of $\theta$ from a normal line of the module 101, and the luminance of the display screen of the module 101 is measured from the angle by the luminance measuring apparatus 102.

Next, in the present embodiment, one pixel is divided into two pixels, so that the luminance of the gradation n, where the respective gradations of the divisional pixels are $n_A$ and $n_B$ at the time, is expressed by the following equation (2):

$$L(\phi, \theta, n) = \frac{L(\phi, \theta, n_A) + L(\phi, \theta, n_B)}{2} \quad (2)$$

Here, a higher contrast is better. The setting of the gradations $n_A$ and $n_B$, to obtain a maximum contrast is shown as follows:

when n=0, $n_A=n_B=0$ when n=255, $n_A=n_B=255$

According to this, the normalized luminance $L_{norm}$ is expressed by the following equation (3):

$$L_{norm}(\phi, \theta, n) = \frac{L(\phi, \theta, n_A) + L(\phi, \theta, n_B)}{2 * L(\phi, \theta, 255)} \quad (3)$$

Preferable is a smaller difference between the numerical value obtained by the equation (3) and the numerical value obtained by the equation (1).

Assuming the difference (error) is e, and by squaring e, the following evaluation function (4) can be obtained:

$$e(\phi, \theta, n)^2 = (L_{norm}(\phi, \theta, n) - \Gamma(2.2, \phi, \theta, n))^2 \quad (4)$$

The error sum total E is expressed by the following equation (5):

$$E = \sum_{\phi=0^\circ}^{360^\circ} \sum_{\theta=0^\circ}^{80^\circ} \sum_{n=0}^{255} e(\phi, \theta, n)^2 \quad (5)$$

Here, when n=0, 1, 2, 3, 4, . . . , 254, 255; $\theta$=0°, 16°, 32°, . . . , 80°; and $\phi$=0°, 22.5°, 45°, . . . , 337.5°, $n_A$ and $n_B$, with respect to each n are found out so that E is a minimum value. The results found out in such a manner are given by the above Table 1.

Note that, for simplicity, the present embodiment treats each azimuth equally. This is because assumed is a liquid crystal display device that can be seen from various viewing angles, such as a large television. The viewing angle square to display screen is weighted most. The weight becomes smaller as the viewing angle increases because a line length becomes longer. The line length here means a circumference of a circle formed by a set of observation points, each of which is at a viewing angle θ with respect to a normal to the display surface, assuming it is apart at a certain distance between a given measurement point on the display and the observation point.

For example, θ is in the range from 0° to 40° in many cases of the use for office automation instruments. Therefore, the evaluation function needs to be determined by increasing the weight for the viewing angles in this range.

Hereinafter, the display operation of the liquid crystal display device utilizing the Table 1 will be explained more specifically. Here, for the convenience of explanation explained is a liquid crystal display device having colors each of 8-bit which is specified by the ASV mode. Furthermore, for the simplification of explanation, the explanation will be carried out with a viewing angle characteristic in the horizontal direction alone. The viewing angle characteristic herein is indicated by a graph showing a relation between a viewing angle and a luminance.

Figure 6:
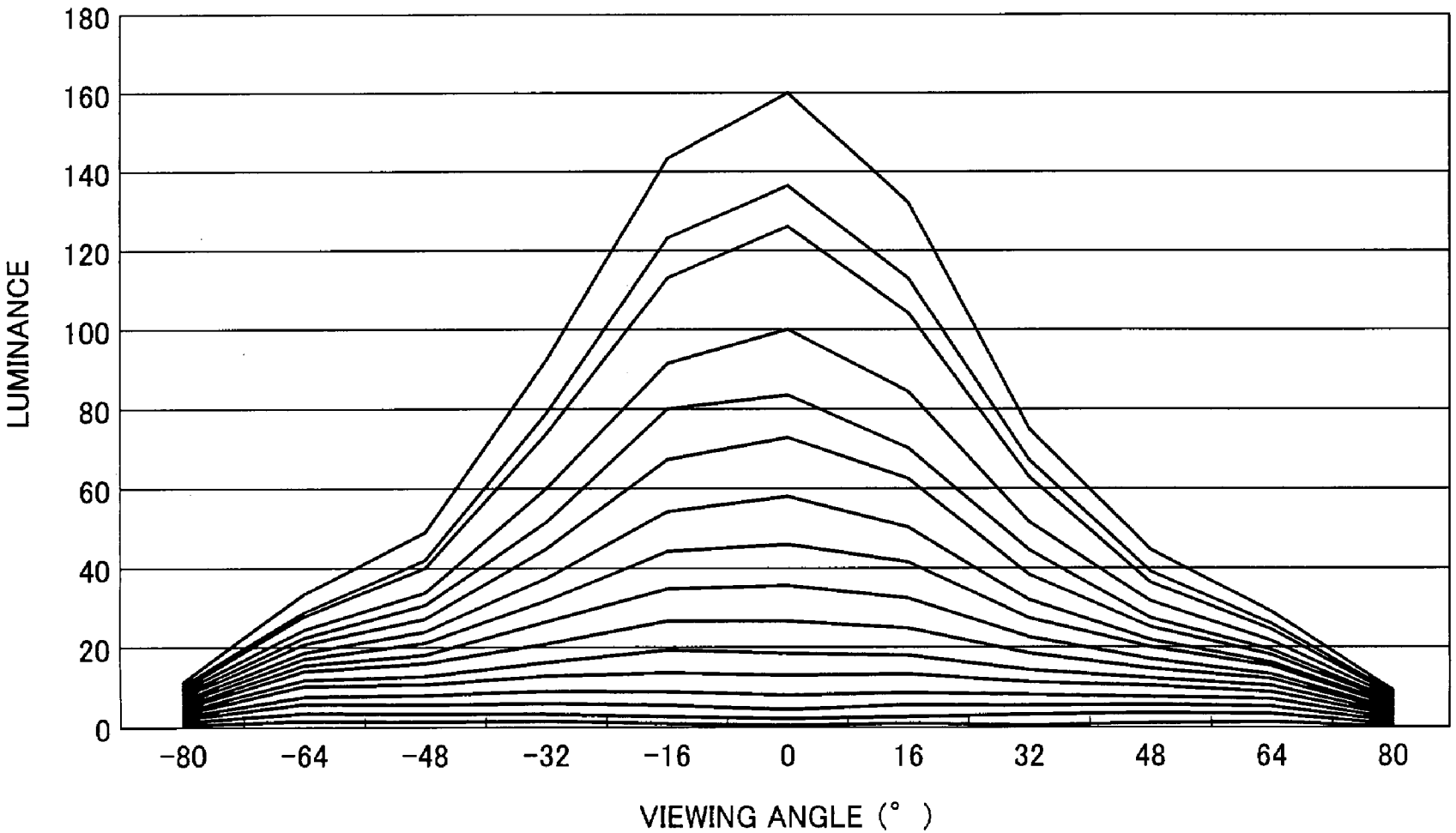
FIG. 6 is a graph showing a relation between a viewing angle and a luminance with respect to a liquid crystal panel displayed in an ASV mode.

First, the viewing angle characteristic at each gradation level in the ASV specified liquid crystal display device is shown in FIG. 6. In FIG. 6, a longitudinal axis indicates a luminance, a lateral axis indicates a viewing angle where a front is set to 0 degree, and − and + represent angles viewed from the left direction and the right direction, respectively. Each line indicates a viewing angle characteristic at each of the gradation levels lined by every 16 gradation levels.

Figure 7:
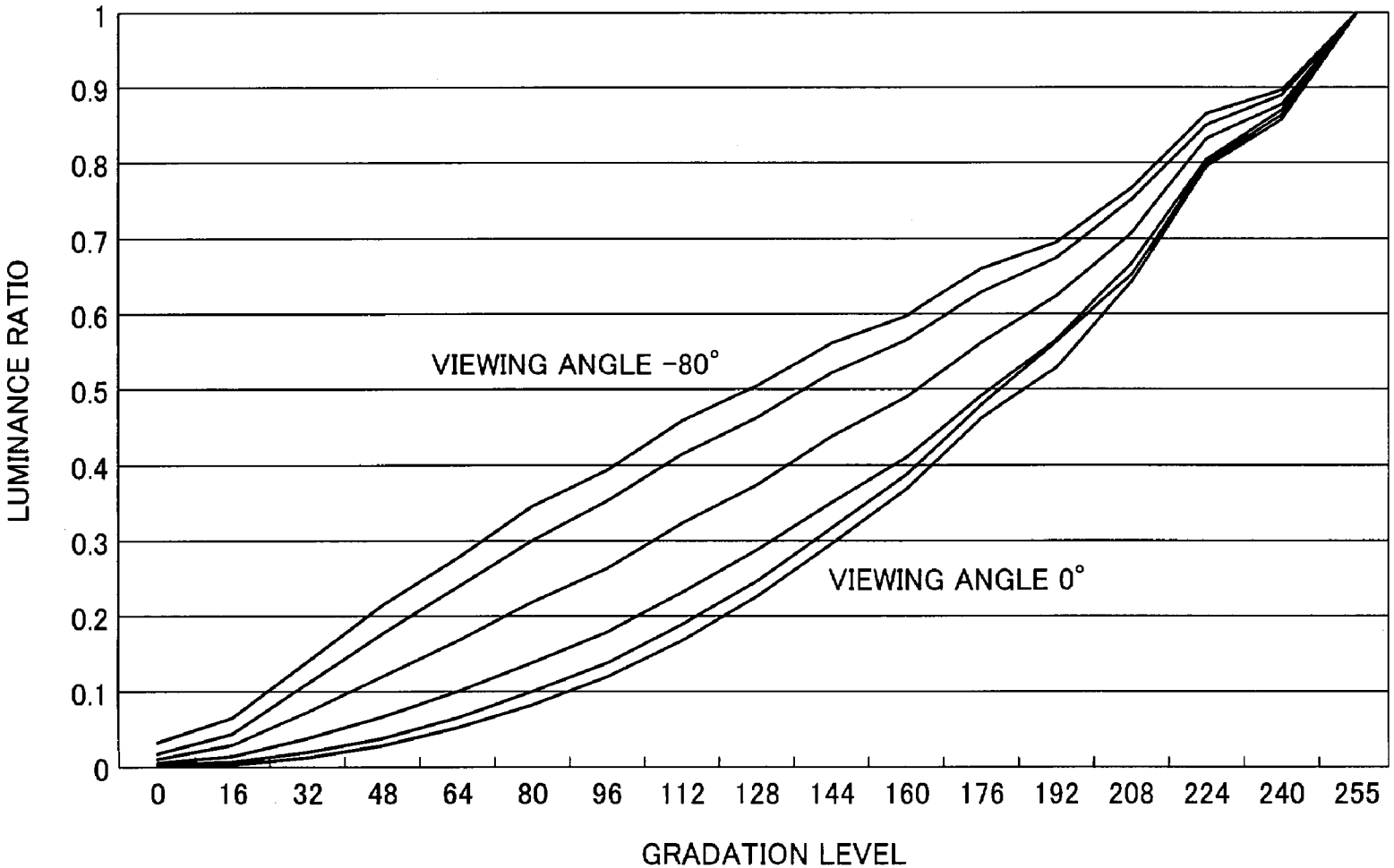
FIG. 7 is a graph showing a relation between a gradation level and a luminance ratio, replaced from the graph shown in FIG. 6.

As seen from the graph shown in FIG. 6, the luminance drops at every gradation level as the angle increases as compared with the front, in other words, as it goes far away from the front. In this condition, it is difficult to evaluate a gradation characteristic, so that normalization is conducted with respect to the luminance of white (V255 gradation level) for every viewing angle. This result is shown in FIG. 7. In FIG. 7, a longitudinal axis indicates a normalized luminance ratio, and a lateral axis indicates a gradation level. Further, as to the viewing angle, data (gradation curve) of the angles viewed only from the left direction (−direction) is shown. The data includes six lines pitched by 16 degrees in the range from −80° to 0°. In FIG. 7, data of viewing angles −80°, −64°, −32°, −16°, 0° are shown in order from the top of the sheet.

As seen from a graph in FIG. 7, the gradation curves of when viewed from the side are raised considerably from that of when viewed from the front. Therefore, under the condition where the gradation curve is as shown in the graph of FIG. 7, the display screen is bleached-looking when viewed from the side, compared with when viewed from the front.

Figure 8:
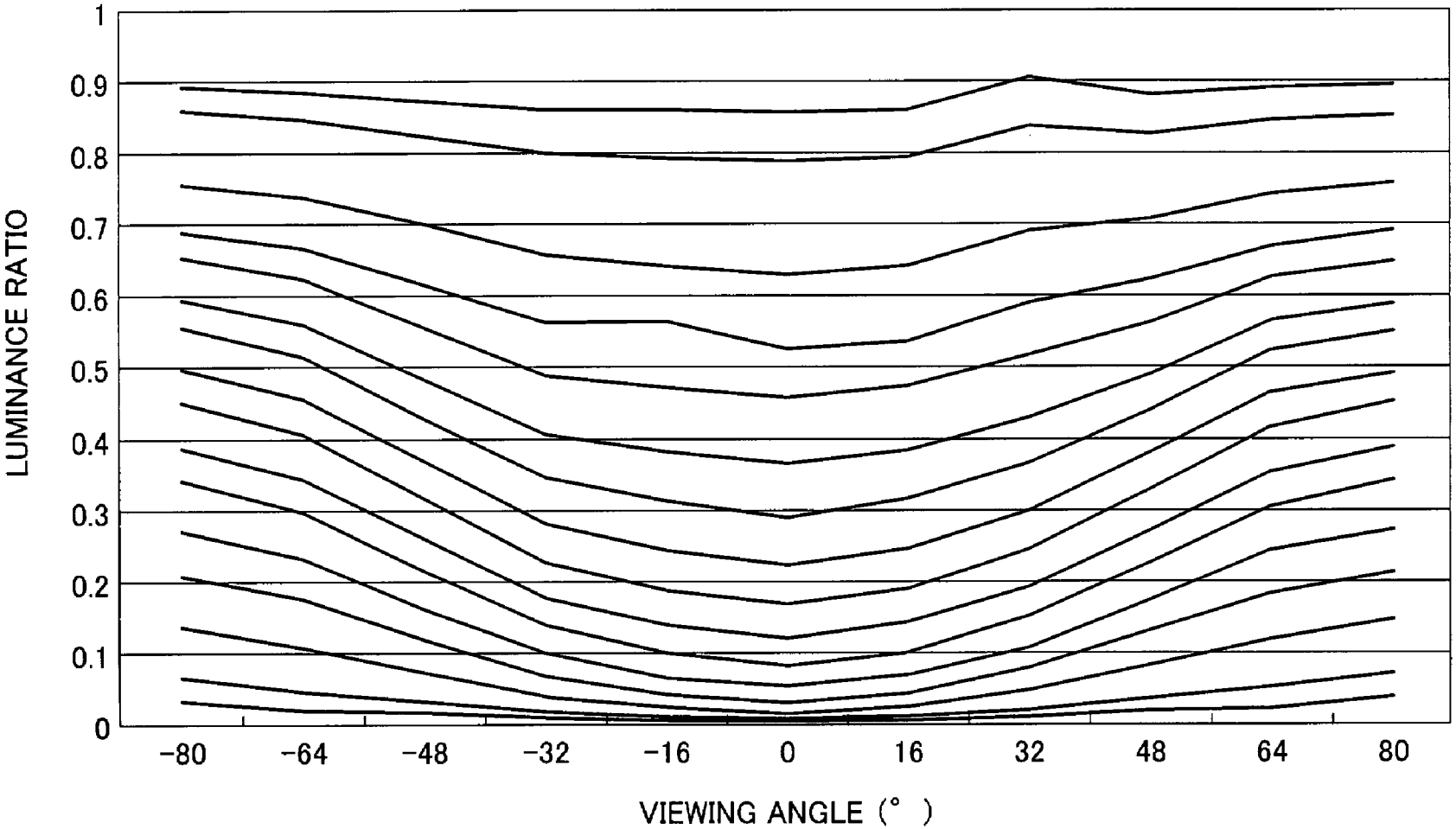
FIG. 8 is a graph showing a relation between a luminance ratio and a viewing angle at each gradation level, replaced from the graph shown in FIG. 6.

FIG. 8 shows this phenomenon more easily. In FIG. 8, a longitudinal axis and a lateral axis indicate a luminance ratio and a viewing angle, respectively, and lines are shown by every 16 gradations.

As seen from the graph in FIG. 8, difference of the luminance ratio in the gradation curve is small between when viewed from the front and from the side as each gradation line forms flatter.

Figure 9:
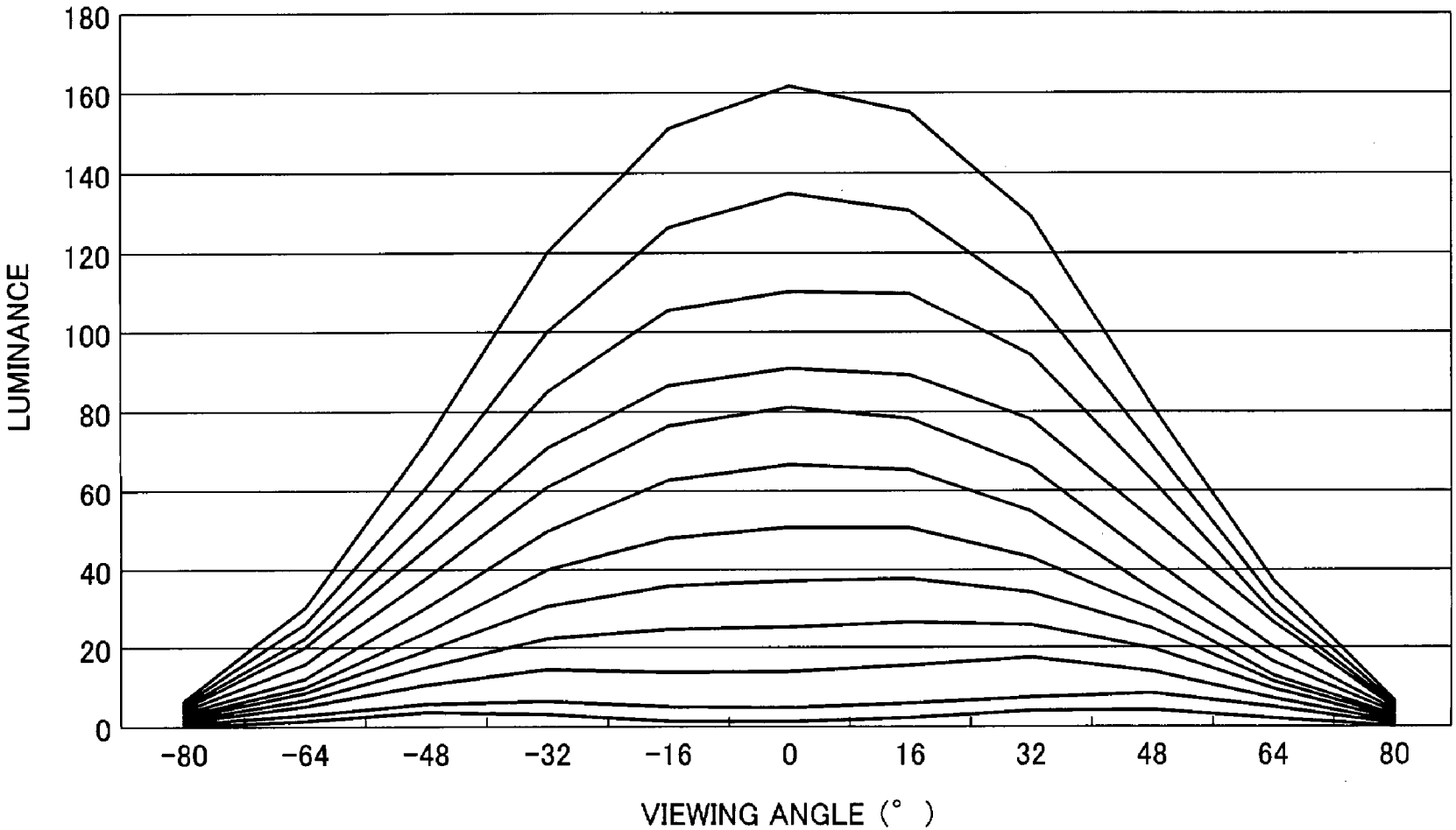
FIG. 9 is a graph showing a relation between a viewing angle and a luminance with respect to a liquid crystal panel in the liquid crystal display device of the present embodiment.

Consequently, in the present embodiment, when the gradations levels of the divisional pixels A and B at each gradation level of the pixel 8 shown in FIG. 3 are set as shown in Table 1, the viewing angle characteristic at each gradation level can be obtained as shown in FIG. 9. In FIG. 9, a longitudinal axis indicates a luminance, a lateral axis indicates a viewing angle where a front is set to 0 degree, and − and + represent angles viewed from the left direction and the right direction, respectively. Each line indicates a viewing angle characteristic at each of the gradation levels lined by every 16 gradation levels.

Figure 10:
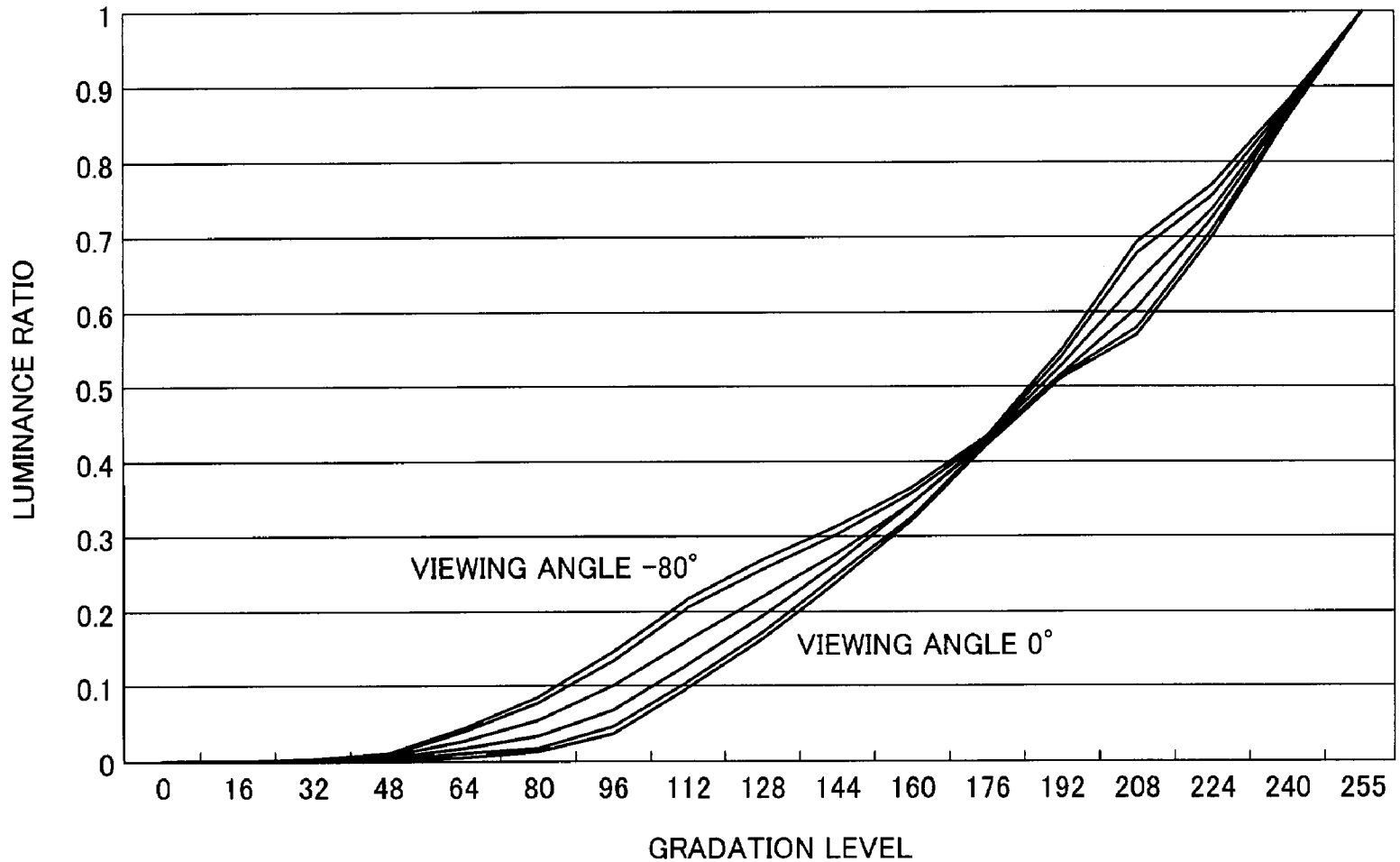
FIG. 10 is a graph showing a relation between a gradation level and a luminance ratio, replaced from the graph shown in FIG. 9.

As seen from the graph in FIG. 9 compared with the graph in FIG. 6, as to each gradation, the luminance does not drop so much at every gradation level even when the angle increases, as compared with the luminance of the front, in other words, even when it goes far away from the front. Regarding this condition, normalization is conducted with respect to the luminance of white (V255 gradation level) for every viewing angle. This result is shown in FIG. 10. In FIG. 10, a longitudinal axis indicates a normalized luminance ratio, and a lateral axis indicates a gradation level. Further, as to the viewing angle, data (gradation curve) of the angles viewed only from the left direction (−direction) is shown. The data includes six lines pitched by 16 degrees in the range from −80° to 0°. In FIG. 10, −80°, −64°, −32°, −16°, 0° are shown in order from the top of the sheet.

As seen from the graph in FIG. 10 as compared with the graph in FIG. 7, the gradation curves are raised slightly on the whole. Therefore, under the condition where the gradation curve is as shown in the graph of FIG. 10, little difference is appeared on the display screen between when viewed from the front and from the side.

Figure 11:
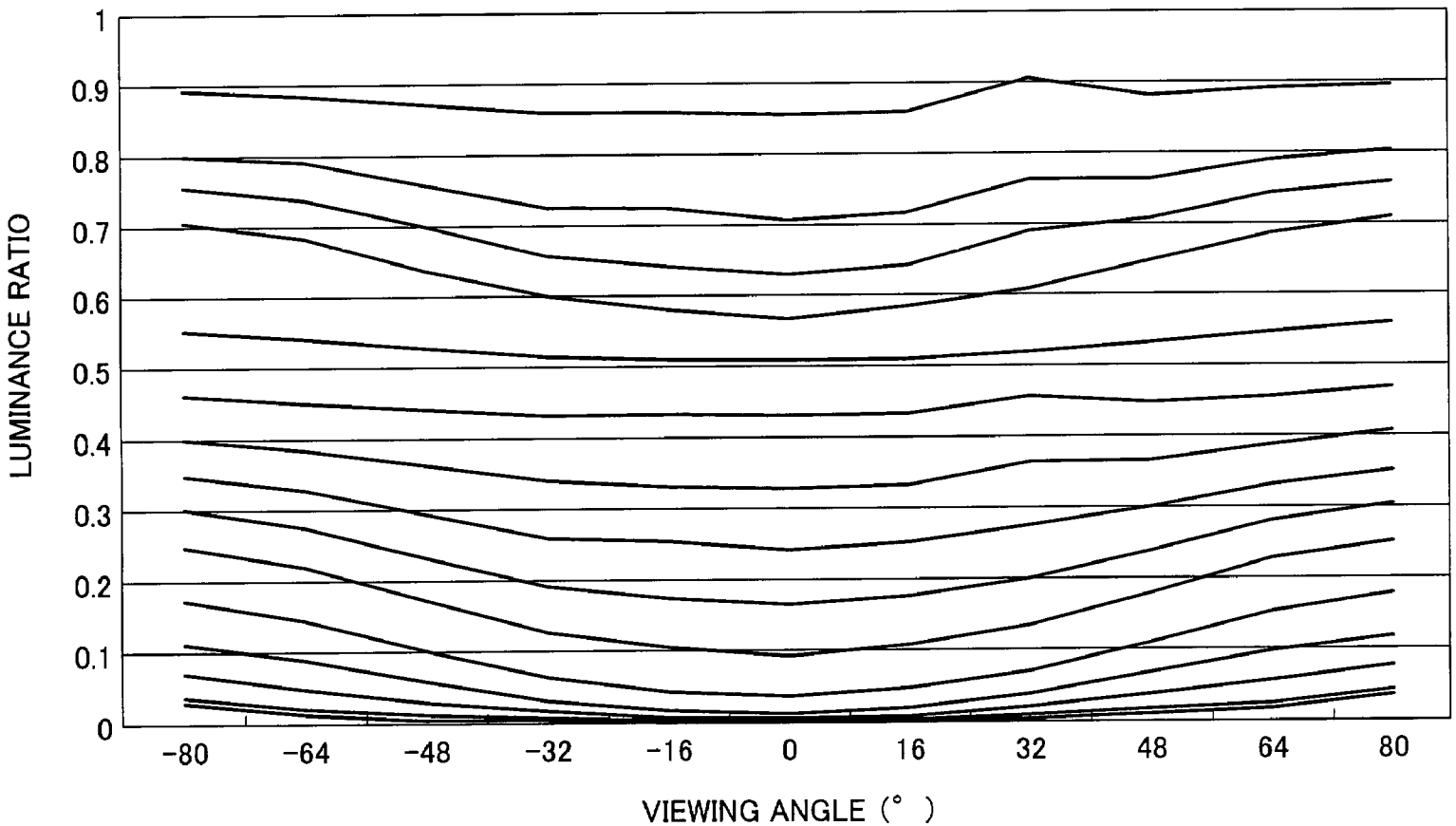
FIG. 11 is a graph showing a relation between a luminance ratio and a viewing angle at each gradation level, replaced from the graph shown in FIG. 9.

FIG. 11 shows this phenomenon more easily. In FIG. 11, a longitudinal axis and a lateral axis indicate a luminance ratio and a viewing angle, respectively, and lines are shown by every 16 gradations.

As seen from a graph in FIG. 11, every line forms flatter at every gradation level than that of the graph in FIG. 8. This means that the gradation characteristic is improved in a wide range of viewing angles. More specifically, the gradation curve's distortion with respect to the viewing angle is improved.

How to find out the numerical values in Table 1 is described above; more specifically, they are found out by the following steps:

(1) Set a target value to a gradation curve based on ITU709, which is a standard in a digital video device.

(2) As to all combinations of the gradations (in the present embodiment, since each pixel of 256 gradation levels has a pair of pixels, $256^2$=65536 kinds of combinations are obtained.), find out the luminance at each viewing angle in each direction (in the present embodiment, 41 kinds of luminances for five kinds of viewing angles: 80°, 64°, 48°, 32°, and 16° by eight directions, in addition to the front).

(3) Calculate the total sum of squared difference (error) between the targeted value (1) at the gradation level 0 and the combination data (2) at each direction and each viewing angle.

(4) Select the combination (2) that has the smallest total sum among the total sums found out at (3). The selected combination is assumed as data of the gradation level 0.

(5) Conduct (3) and (4) for every gradation levels (256 gradation levels) and select the combination data of each gradation level.

As described above, in the liquid crystal display device according to the present embodiment, one pixel is composed of two divisional pixels, and the gradation data as shown in Table 1 is set to each divisional pixel so that a curve showing a relation with respect to gradation level between the viewing angle and the luminance ratio as shown in FIG. 11, i.e. a gradation characteristic in a wide range of viewing angles can be secured, whereby the gradation characteristic can be improved in a wide range of viewing angles.

Note that, the example of one pixel divided into two pixels has been explained in the present embodiment; however, the number of divisions is not especially limited.

Increase in the number of divisions in the one pixel, i.e. increase in the number of sub-pixels constituting one pixel makes easy adjustment of the gradation on the display screen and easy improvement in the display performance.

However, it is preferable that the number of sub-pixels is decided in view of the purpose of using the liquid crystal display device because the increase in the number of sub-pixels has the following problems:

(1) The corresponding number of drive circuits is required as the number of the sub-pixels increases, and micro fabrication for the sub-pixels is also required. This results in increase in manufacturing cost of the liquid crystal display device.

(2) Increase in the number of circuits increases elements such as wires inside the liquid crystal panel, which reduces an open area ratio and transmittance, so that the additional amount of light is required for securing a luminance. This increases the power consumption of a back light, thereby increasing the cost of the back light.

Note that, in case where one pixel is divided into two pixels as in the present embodiment, the look-up table as shown in Table 1 can be installed inside the source drive circuit 5. This is effective for the suppression of increase in the size of circuit.

[Second Embodiment]

The following will explain another embodiment of the present invention. Note that, as to a liquid crystal display device according to the present embodiment, detailed explanations are omitted here because it has substantially the same arrangement as the liquid crystal display device, which is shown in FIG. 1, described in First Embodiment.

Figure 12:
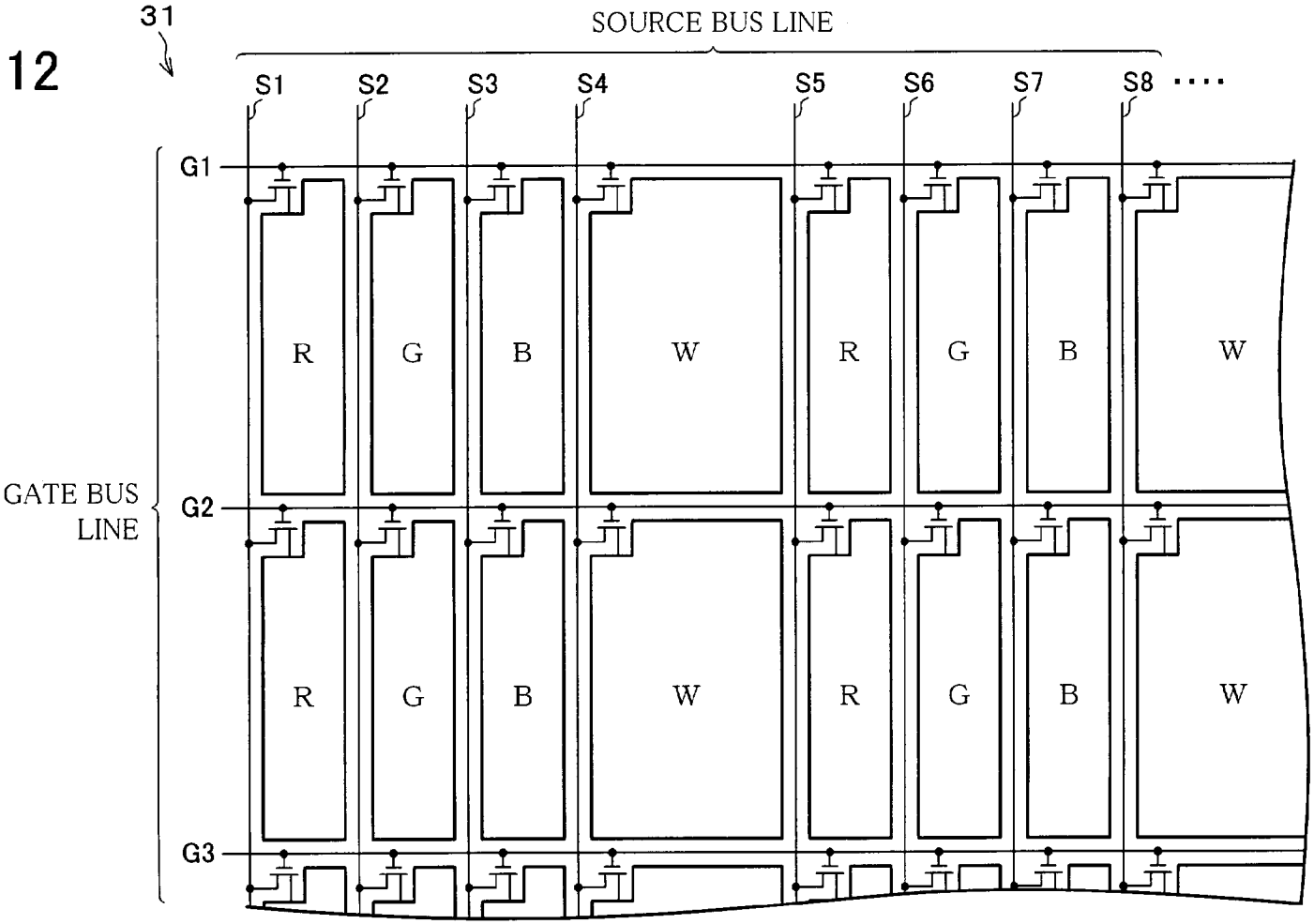
FIG. 12 is a plane view of a liquid crystal panel provided in a liquid crystal display device according to another embodiment of the present invention.

Unlike the liquid crystal display device 1 in the above First Embodiment, the liquid crystal display device according to the present embodiment includes a liquid crystal panel 31 as shown in FIG. 12.

Figure 13:
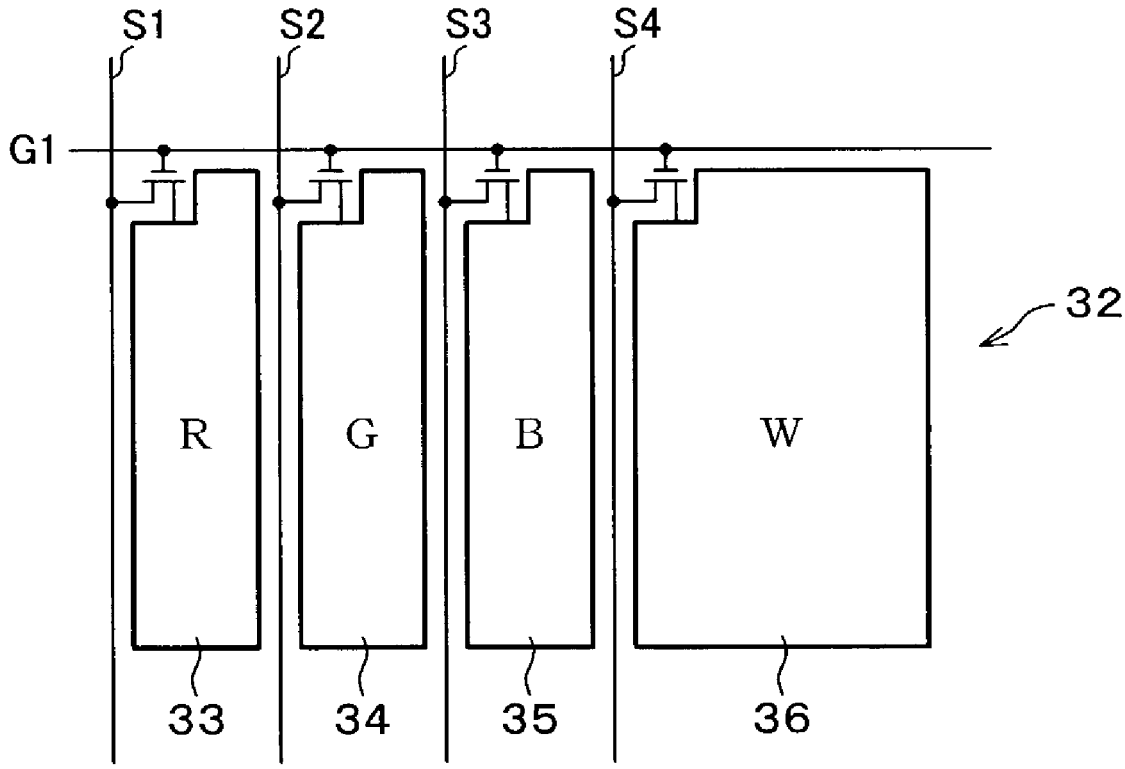
FIG. 13 is a plane view showing a main part of pixels constituting the liquid crystal panel shown in FIG. 12.

The liquid crystal panel 31 has an arrangement in which one pixel includes a pixel electrode of white (W), in addition to the pixel electrodes, red (R), green (G), blue (B). More specifically, as shown in FIG. 13, one pixel 32 is composed of four sub-pixels: a red sub-pixel 33, a green sub-pixel 34, a blue sub-pixel 35, and a white sub-pixel 36, and four sub-pixels are combined to display.

The sub-pixels are independently connected to the respective source bus lines S1 to S4 and are connected to the same gate bus line G1. This can apply different source drive voltages to the respective sub-pixels.

The liquid crystal panel 31 is driven by a pixel data for source drive, a control signal for source drive, and a control signal for gate drive all of which are generated by a drive signal generation section arranged as in the drive signal generation section 2 which is provided in the liquid crystal display device 1 of First Embodiment.

The pixel data for source drive is generated with reference to the LUT 3 as in First Embodiment. Gradation data set at this moment is given by the following Table 2.

TABLE 2

| Vector D= | Vector A (Vector D)= | B(Vector D)= |
|---|---|---|
| 0, 0, 0 | 0, 0, 0 | 0 |
| 0, 0, 1 | 0, 0, 1 | 0 |
| 0, 0, 2 | 0, 0, 3 | 0 |
| 0, 0, 3 | 0, 0, 4 | 0 |
| . . . | . . . | . . . |
| 16, 16, 16 | 0, 0, 0 | 3 |
| . . . | . . . | . . . |
| 32, 32, 32 | 0, 0, 0 | 7 |
| . . . | . . . | . . . |
| 48, 48, 48 | 0, 0, 0 | 9 |
| . . . | . . . | . . . |
| 64, 64, 64 | 0, 0, 0 | 27 |
| . . . | . . . | . . . |
| 80, 80, 80 | 0, 0, 0 | 46 |
| . . . | . . . | . . . |
| 96, 96, 96 | 0, 0, 0 | 75 |
| . . . | . . . | . . . |
| 112, 112, 112 | 0, 0, 0 | 118 |
| . . . | . . . | . . . |
| 128, 128, 128 | 0, 0, 0 | 152 |
| . . . | . . . | . . . |
| 144, 144, 144 | 0, 0, 0 | 182 |
| . . . | . . . | . . . |
| 160, 160, 160 | 0, 0, 0 | 210 |
| . . . | . . . | . . . |
| 176, 176, 176 | 0, 0, 0 | 240 |
| . . . | . . . | . . . |
| 192, 192, 192 | 25, 25, 25 | 255 |
| . . . | . . . | . . . |
| 208, 208, 208 | 101, 101, 101 | 255 |
| . . . | . . . | . . . |
| 224, 224, 224 | 197, 197, 197 | 240 |
| . . . | . . . | . . . |
| 240, 240, 240 | 238, 238, 238 | 241 |
| . . . | . . . | . . . |
| 255, 255, 255 | 255, 255, 255 | 255 |

Here, the following will specifically explain the operation of the drive signal generation section.

First, original data (input image data) is:

{R1, G1, B1}, {R2, G2, B2}, {R3, G3, B3}, {R4, G4, B4}, {R5, G5, B5}, . . . , where the parentheses { } indicate a segment of one pixel data, and input data is made from a combination of (R, G, B). Vector D in Table 2 indicates this combination data.

At this time, the data (output data) outputted from the pixel data conversion section 21, which is data (pixel data for source drive) converted from the original data in accordance with the reference result of the LUT 3, e.g. the reference result shown in Table 1, is:

{Vector A(R1, G1, B1), B(R1, G1, B1)}, {Vector A(R2, G2, B2), B(R2, G2, B2)}, {Vector A(R3, G3, B3), B(R3, G3, B3)}, . . .

In the present embodiment, as shown in FIG. 13, one pixel 32 is composed of four sub-pixels, so that pixel data is composed of four elements. Note that, the Vector A has three elements, which indicates three sub-pixels of R, G, B; and the Vector B has only one element, which indicates a sub-pixel of W.

Therefore, the drive signal generation section generates, in addition to pixel data for source drive, control signals for source drive, such as a source clock for control of data capture, a source start pulse indicating start of data, and a latch pulse controlling the switching of source output, which are control signals necessary in the liquid crystal panel 31; and the drive signal generation section transmits them to the source drive circuit.

Further, the drive signal generation section generates signals for controlling the gate drive circuit simultaneously, i.e. control signals for gate drive, such as a gate clock indicating timing of applied gate bus line's shift and a gate start pulse indicating a start of frame switching; and transmits them to the gate drive circuit.

The source drive circuit applies desired voltages to the source bus lines in accordance with pixel data for source drive transmitted from the drive signal generation section and a voltage value transmitted from the drive voltage generation section.

For example, assuming Vector A=(A1, A2, A3), in FIG. 13, a voltage required for the display of A1(R1, G1, B1)'s gradation is applied to a source bus line S1, a voltage required for the display of A2(R1, G1, B1)'s gradation is applied to a source bus line S2, a voltage required for the display of A3(R1, G1, B1)'s gradation is applied to a source bus line S3, a voltage required for the display of B(R1, G1, B1)'s gradation is applied to a source bus line S4, a voltage required for the display of A1(R1, G1, B1)'s gradation is applied to a source bus line S5, and a voltage required for the display of A2(R1, G1, B1)'s gradation is applied to a source bus line S6. Likewise, voltages required for the display of the pixels' gradations are applied to the respective source bus lines.

An LUT, which is referred when the pixel data for source drive is generated in the drive signal generation section, can be obtained by the same method as that explained in First Embodiment; therefore the explanation thereof is omitted here.

Incidentally, in a usual liquid crystal display device, one pixel is composed of sub-pixels of three primary colors: red, green, and blue. In First Embodiment, one pixel is composed of three sub-pixels each of which are divided into two or more parts. Consequently, the number of actually driving sub-pixels becomes twice or more the number of pixels, resulting in the problem of increase in a circuit size of the liquid crystal panel.

To solve such a problem, in the present embodiment, a white sub-pixel is added to one pixel for an increased viewing angle, without dividing the sub-pixels of red, green, and blue. This decreases the circuit size to three-fourth that of the liquid crystal panel of only three sub-pixels: red, green and blue.

However, LUT of the present embodiment is larger than that of First Embodiment because the gradation characteristic must be corrected with respect to the combination of red, green and blue in the present embodiment, while the gradation characteristic may be individually corrected with respect to each sub-pixel by red for the sub-pixel of red, green for the sub-pixel of green, and blue for the sub-pixel of blue in First Embodiment.

In either case, a gradation characteristic can be improved, and a viewing angle characteristic in a wide range of viewing field can be improved, so that the quality level of display image is higher than that of the conventional liquid crystal display device with an increased viewing angle.

For example, in the present embodiment, to obtain the effect of the increased viewing angle, it is set so as to be: the luminance of white pixel at gradation level n=the luminance of red sub-pixel at gradation level n+the luminance of green sub-pixel at gradation level n+the luminance of blue sub-pixel at gradation level n, and gradation of each sub-pixel is set as shown in Table 2. This makes it possible to increase display quality at the halftone of black and white in the liquid crystal panel 31 of the present embodiment, as in First Embodiment.

Note that, in the present embodiment, only one white sub-pixel is added as a sub-pixel for the correction of the gradation characteristic. However, the present invention is not limited to this, and a plurality of sub-pixels may be used as the sub-pixel for the correction of the gradation characteristic.

Further, increase in the number of divisions in one pixel, i.e. increase in the number of sub-pixels constituting one pixel makes easy adjustment in the gradation on the display screen and easy improvement in the display performance.

However, the increase in the number of sub-pixels is accompanied by the problems (1) and (2) as described in First Embodiment. Therefore, it is preferable that the number of sub-pixels is decided in view of the purpose of using the liquid crystal display device.

Note that, in case where there is one additional sub-pixel other than the sub-pixels having respectively three primary colors, white is provided for the additional sub-pixel. In case where there are two additional sub-pixels, green and red are preferably provided for the additional sub-pixels because contribution ratio to the luminance of green is high. Further, in case where there are three additional sub-pixels other than the sub-pixels having respectively three primary colors, three primary colors of red, green, and blue are preferably provided for the additional sub-pixels.

[Third Embodiment]

The following will explain still another embodiment of the present invention. Note that, members having the same functions as those described in the foregoing embodiments are given the same reference numerals and explanations thereof are omitted here.

Figure 14:
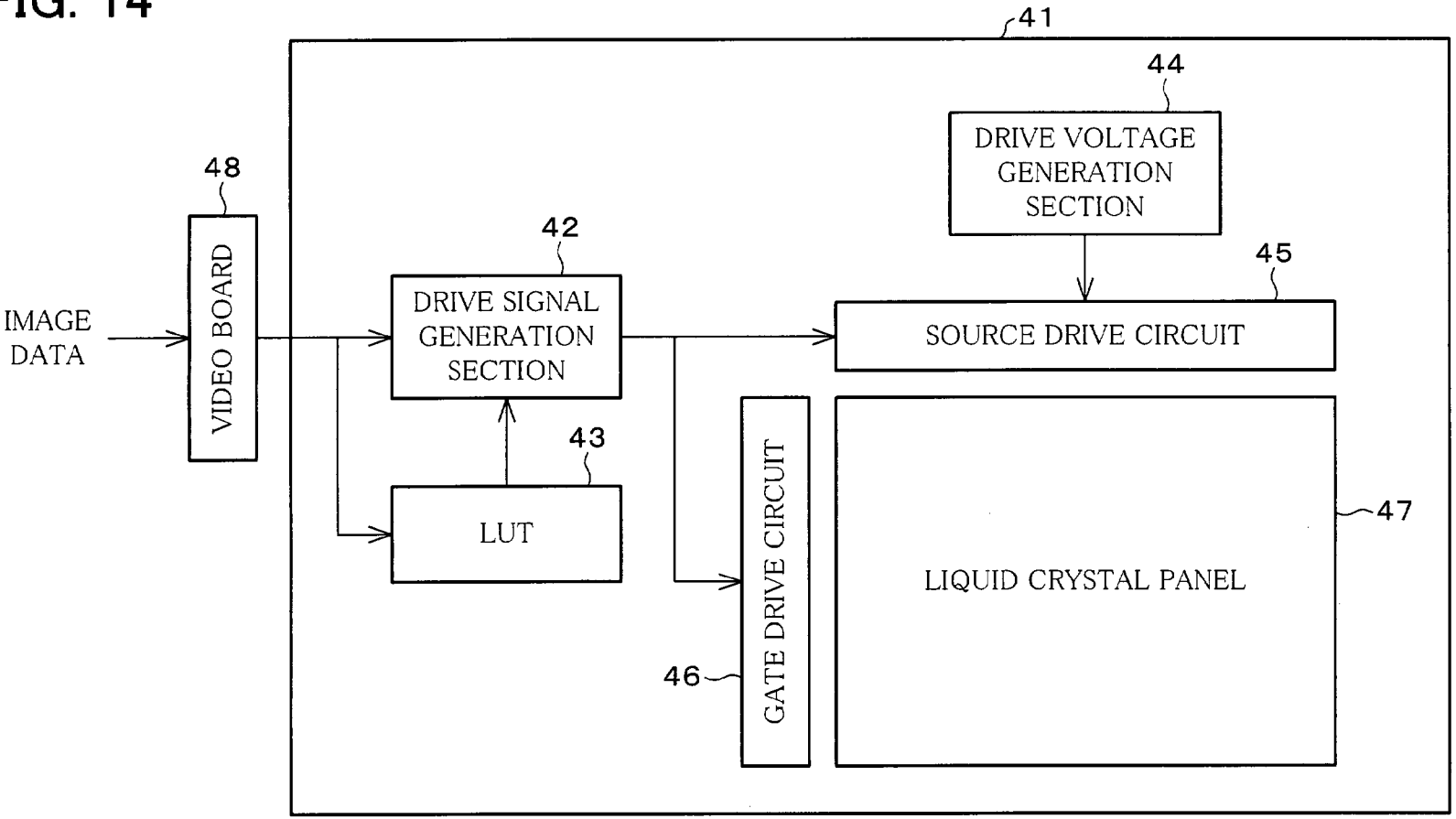
FIG. 14 is a block diagram schematically showing an arrangement of a liquid crystal display device according to still another embodiment of the present invention.

As shown in FIG. 14, the liquid crystal display device 41 according to the present embodiment has the same arrangement as that of the liquid crystal display device 1 shown in FIG. 1 of First Embodiment. More specifically, the liquid crystal display device 41 includes a drive signal generation section 42, an LUT 43, a drive voltage generation section 44, a source drive circuit 45, a gate drive circuit 46, a liquid crystal panel 47; and has a further arrangement in which image data is supplied via a video board 48 to the drive signal generation section 42. The video board 48 is a board for digitalizing image data.

Note that, as to the liquid crystal display device 41, detailed explanations are omitted here because it has substantially the same arrangement as the liquid crystal display device 1 described in First Embodiment, except for the liquid crystal panel 47 and the video board 48.

Figure 15:
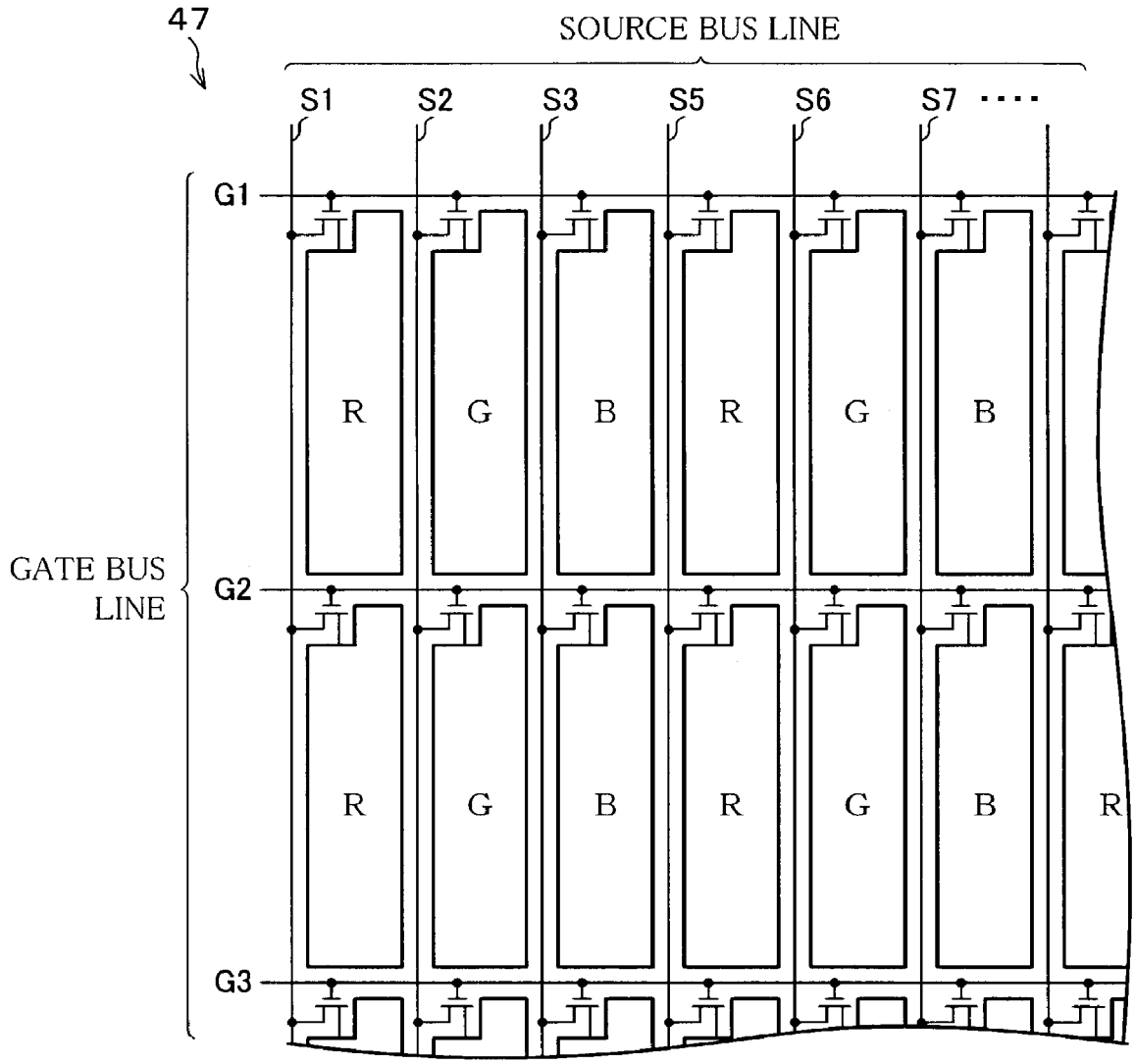
FIG. 15 is a plane view of a liquid crystal panel provided in the liquid crystal display device shown in FIG. 14.

As shown in FIG. 15, the liquid crystal panel 47, which is provided with pixel electrodes at the intersections of source bus lines and gate bus lines, are driven by pixel data for source drive and a control signal for source drive, which are applied to the source bus line, and a control signal for gate drive, which is applied to the gate bus line, so that a desired image is displayed thereon.

In the liquid crystal panel 47, as in the usual liquid crystal display device, one pixel is composed of three sub-pixels of three primary colors: red, green and blue.

In the present embodiment, the drive signal generation section 42 sets the gradations of frame 2n and frame 2n+1 of each pixel at each gradation level as shown in Table 3.

TABLE 3

| D= | A(D)= | B(D)= |
|---|---|---|
| 0 | 0 | 0 |
| . . . | . . . | . . . |
| 16 | 0 | 3 |

TABLE 3-continued

| D= | A(D)= | B(D)= |
|---|---|---|
| ... | ... | ... |
| 32 | 0 | 7 |
| ... | ... | ... |
| 48 | 0 | 9 |
| ... | ... | ... |
| 64 | 0 | 27 |
| ... | ... | ... |
| 80 | 0 | 46 |
| ... | ... | ... |
| 96 | 0 | 75 |
| ... | ... | ... |
| 112 | 0 | 118 |
| ... | ... | ... |
| 128 | 0 | 152 |
| ... | ... | ... |
| 144 | 0 | 182 |
| ... | ... | ... |
| 160 | 0 | 210 |
| ... | ... | ... |
| 176 | 0 | 240 |
| ... | ... | ... |
| 192 | 25 | 255 |
| ... | ... | ... |
| 208 | 101 | 255 |
| ... | ... | ... |
| 224 | 197 | 240 |
| ... | ... | ... |
| 240 | 238 | 241 |
| ... | ... | ... |
| 255 | 255 | 255 |

In Table 3, D indicates a gradation level, A(D) indicates a gradation of frame 2n, and B(D) indicates a gradation of frame 2n + 1.

For example, in case where a gradation level D=144 is displayed, a certain frame displays the gradation A(D)=0, and the subsequent frames display the gradation B(D)=182, the gradation A(D)=0, and the gradation B(D)=182, respectively. In other words, the frames in one pixel display respectively different gradations. The frame switching performed at a sufficiently high speed causes a color mixture to occur by image persistence, and the color appears a middle luminance to human eye.

A curve showing a relation with respect to gradation level between the viewing angle and the luminance ratio obtained in such a manner is given by the same graph as that of First Embodiment, as shown in FIG. 11.

Here, the following will specifically explain the frame operation.

First, 2n ("n" is natural number) frame operation is explained.

Input data of the 2n frame is:

{R1(2n), G1(2n), B1(2n)}, {R2(2n), G2(2n), B2(2n)}, {R3(2n), G3(2n), B3(2n)}, {R4(2n), G4(2n), B4(2n)}, . . . , where the parentheses { } indicate a segment of one pixel data, and input data is made from a combination of (R, G, B).

At this time, the pixel data for source drive (output data) outputted from the drive signal generation section 42 is:

{A(R1(2n)), A(G1(2n)), A(B1(2n))}, {A(R2(2n)), A(G2(2n)), A(B2(2n))}, . . . In the present embodiment, one pixel data inside the parentheses { } is composed of three kinds of pixel data. Therefore, the drive signal generation section 42 adds to pixel data for source drive, which is generated from the pixel data in accordance with the reference result of the LUT 43, control signals for source drive, such as a source clock for control of data capture, a source start pulse indicating start of data, and a latch pulse controlling the switching of source output; and the drive signal generation section 42 transmits them to the source drive circuit 45.

Further, the drive signal generation section 42 generates signals for controlling the gate drive circuit 46 simultaneously. The drive signal generation section 42 generates control signals for gate drive such as a gate clock indicating timing of applied gate bus line's shift and a gate start pulse indicating a start of frame switching, and transmits them to the gate drive circuit 46.

The source drive circuit 45 sets voltages to be applied to the source bus lines in accordance with the pixel data for source drive and control signals transmitted; and a voltage value transmitted from the drive voltage generation section 44.

Consequently, in the source bus lines shown in FIG. 15, a voltage required for the display of A(R1(2n))'s gradation is applied to a source bus line S1, a voltage required for the display of A(G1(2n))'s gradation is applied to a source bus line S2, a voltage required for the display of A(B1(2n))'s gradation is applied to a source bus line S3, a voltage required for the display of A(R2(2n))'s gradation is applied to a source bus line S4, a voltage required for the display of A(G2(2n))'s gradation is applied to a source bus line S5, and a voltage required for the display of A(B2(2n))'s gradation is applied to a source bus line S6.

Next, 2n+1 ("n" is natural number) frame operation is explained.

Input data of the 2n+1 frame is:

{R1(2n+1), G1(2n+1), B1(2n+1)}, {R2(2n+1), G2(2n+1), B2(2n+1)}, {R3(2n+1), G3(2n+1), B3(2n+1)}, {R4(2n+1), . . . , where the parentheses { } indicate a segment of one pixel data, and input data is made from a combination of (R, G, B).

At this time, the pixel data for source drive (output data) outputted from the drive signal generation section 42 is:

{B(R1(2n+1)), B(G1(2n+1)), B(B1(2n+1))}, {B(R2(2n+1)), B(G2(2n+1)), B(B2(2n+1))}, . . .

In the present embodiment, one pixel data inside the parentheses { } is composed of three kinds of pixel data. Therefore, the drive signal generation section 42 generates pixel data for source drive from the three kinds of pixel data in accordance with the reference result of the LUT 43, and generates control signals for source drive, such as a source clock for control of data capture, a source start pulse indicating start of data, and a latch pulse controlling the switching of source output; and the drive signal generation section 42 transmits them to the source drive circuit 45.

Further, the drive signal generation section 42 simultaneously generates control signals for gate drive for controlling the gate drive circuit 46, such as a gate clock indicating timing of applied gate bus line's shift and a gate start pulse indicating a start of frame switching, and transmits them to the gate drive circuit 46.

The source drive circuit 45 sets voltages to be applied to the source bus lines in accordance with the pixel data for source drive and control signals transmitted; and a voltage value transmitted from the drive voltage generation section 44.

In the source bus lines shown in FIG. 15, a voltage required for the display of B(R1(2n+1))'s gradation is applied to a source bus line S1, a voltage required for the display of B(G1(2n+1))'s gradation is applied to a source bus line S2, a voltage required for the display of B(B1(2n+1))'s gradation is applied to a source bus line S3, a voltage required for the display of B(R2(2n+1))'s gradation is applied to a source bus line S4, a voltage required for the display of B(G2(2n+1))'s gradation is applied to a source bus line S5, and a voltage required for the display of B(B2(2n+1))'s gradation is applied to a source bus line S6.

With the above operation, color mixture of colors between frames is conducted.

In the above arrangement, in the drive signal generation section 42, a frame cycle when the image data is inputted is the same as that when the generated image data is outputted. For this reason, it is necessary to decrease a frame frequency when mixture of colors is conducted at the time of output.

Figure 16:
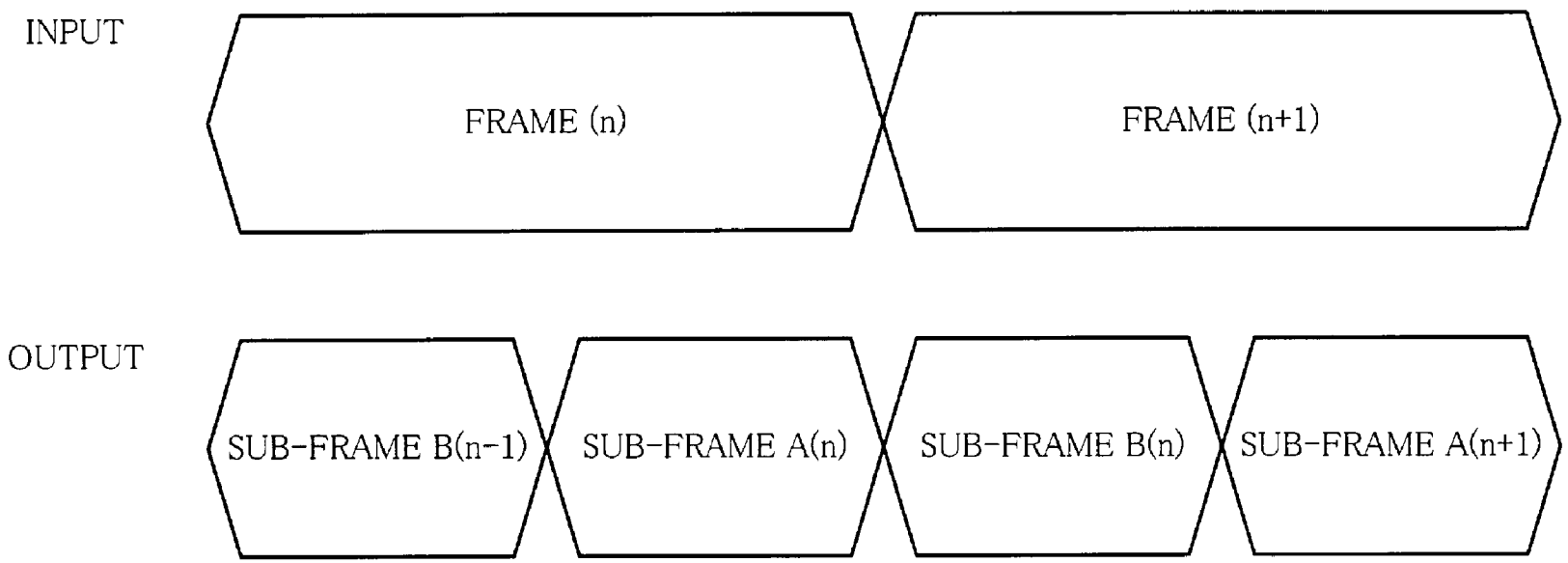
FIG. 16 is a view showing the state of data input and output in a drive signal generation section of the liquid crystal display device shown in FIG. 14.

Consequently, as shown in FIG. 16, the frame at the time of output is divided into sub-frames each having a half cycle of the frame at the time of input so that color mixture can be conducted without decreasing the frame frequency.

For example, input data is:

{R1, G1, B1}, {R2, G2, B2}, {R3, G3, B3}, {R4, G4, B4}, . . . , where the parentheses { } indicate a segment of one pixel data, and input data is made from a combination of (R, G, B).

The output data of sub-frame A is:

{A(R1), A(G1), A(B1)}, {A(R2), A(G2), A(B2)}, . . . In the present embodiment, one pixel data inside the parentheses { } is composed of three kinds of pixel data. Therefore, the drive signal generation section 42 generates pixel data for source drive from the three kinds of pixel data. Further, in addition to the generated pixel data, the drive signal generation section 42 adds control signals for source drive, such as a source clock for control of data capture, a source start pulse indicating start of data, and a latch pulse controlling the switching of source output; and transmits them to the source drive circuit 45.

Further, the drive signal generation section 42 simultaneously generates control signals for gate drive for controlling the gate drive circuit 46, i.e. a gate clock indicating timing of applied gate bus line's shift and a gate start pulse indicating a start of frame switching, and transmits them to the gate drive circuit 46.

The source drive circuit 45 sets voltages to be applied to the source bus lines in accordance with the pixel data for source drive and control signals transmitted; and a voltage value transmitted from the drive voltage generation section 44.

In the source bus lines shown in FIG. 15, a voltage required for the display of A(R1)'s gradation is applied to a source bus line S1, a voltage required for the display of A(G1)'s gradation is applied to a source bus line S2, a voltage required for the display of A(B1)'s gradation is applied to a source bus line S3, a voltage required for the display of A(R2)'s gradation is applied to a source bus line S4, a voltage required for the display of A(G2)'s gradation is applied to a source bus line S5, and a voltage required for the display of A(B2)'s gradation is applied to a source bus line S6.

The operation of the sub-frame A is performed in half of the time period taken for that of the original frame.

Meanwhile, the output data of sub-frame B is:

{B(R1), B(G1), B(B1)}, {B(R2), B(G2), B(B2)}, . . .

In the present embodiment, one pixel data inside the parentheses { } is composed of three kinds of pixel data. Therefore, the drive signal generation section 42 generates pixel data for source drive, in addition to control signals for source drive, such as a source clock for control of data capture, a source start pulse indicating start of data, and a latch pulse controlling the switching of source output; and the drive signal generation section 42 transmits them to the source drive circuit 45.

Further, the drive signal generation section 42 simultaneously generates control signals for gate drive, such as a gate clock indicating timing of applied gate bus line's shift and a gate start pulse indicating a start of frame switching, as control signals for controlling the gate drive circuit 46, and transmits them to the gate drive circuit 46.

The source drive circuit 45 sets voltages to be applied to the source bus lines in accordance with the pixel data for source drive and control signals transmitted; and a voltage value transmitted from the drive voltage generation section 44.

In the source bus lines shown in FIG. 15, a voltage required for the display of B(R1)'s gradation is applied to a source bus line S1, a voltage required for the display of B(G1)'s gradation is applied to a source bus line S2, a voltage required for the display of B(B1)'s gradation is applied to a source bus line S3, a voltage required for the display of B(R2)'s gradation is applied to a source bus line S4, a voltage required for the display of B(G2)'s gradation is applied to a source bus line S5, and a voltage required for the display of B(B2)'s gradation is applied to a source bus line S6.

As the operation of the sub-frame A, the operation of the sub-frame B is also performed in half of the time period taken for that of the original frame.

The outputs of the sub-frames A and B are carried out continuously. The operation carried out for each input frame causes color mixture of colors between frames.

Figure 17:
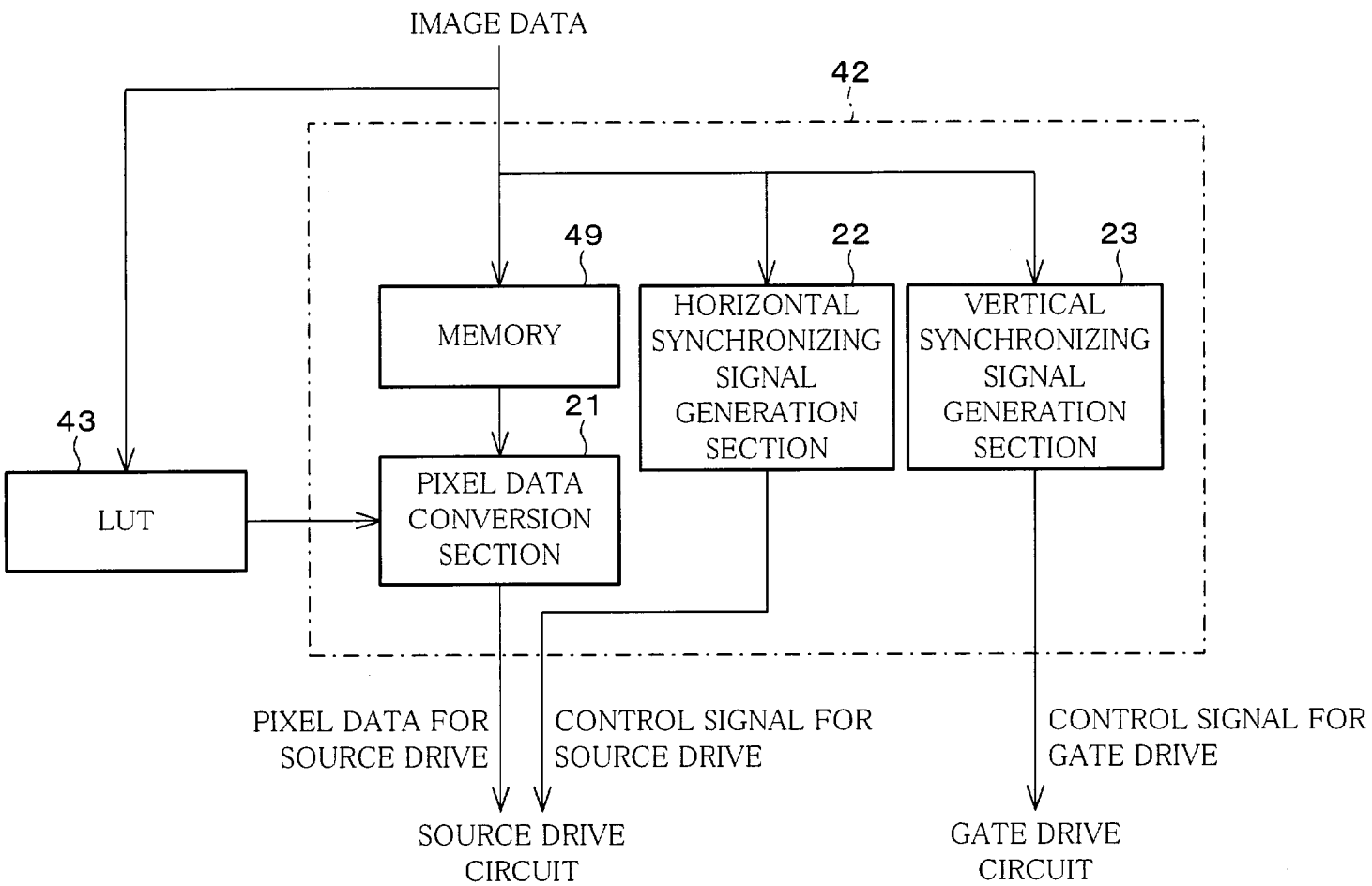
FIG. 17 is a block diagram schematically showing an arrangement of the drive signal generation section in the liquid crystal display device shown in FIG. 14.

The drive signal generation section 42 for realizing a method of dividing the input frame as shown in FIG. 16 into two sub-frames is arranged, as shown in FIG. 17, so that image data, which is input data, is supplied via a memory 49 to a pixel data conversion section 21. Except for this arrangement, the drive signal generation section 42 has the same arrangement as that of the drive signal generation section 2 shown in FIG. 4 in First Embodiment.

More specifically, in the present embodiment, image data is once stored in the memory 49 so that pixel data for source drive is generated with a time delay in the pixel data conversion section 21.

As described above, even in case where a frame is considered, as in First Embodiment, gradation characteristic can be improved at the halftone of black and white, which results in excellent viewing angle characteristic. This can reduce the gradation curve's distortion in the liquid crystal panel with an increased viewing angle.

As the case described above, a pixel is not composed of plural sub-pixels, but a frame for display of one pixel is composed of plural sub-frames. This uses the image persistence of human eye, and the adjustment in the number of sub-frames causes a color mixture for human eye.

For this reason, a simple increase in the number of sub-frames cannot increase the display performance, unlike the case of the simple increase in the number of sub-pixels. This is because the change by continuous output of the sub-frames simply increased in number just looks like the flicker of colors, not color mixture, for human eye.

Therefore, one set of the change must be completed while the change causes the color mixture to occur for human eye. The one set of the change in this case must occur at the frequencies from 30 Hz to 80 Hz.

Further, in case where the number of sub-frames is increased, in other words, the number of frame divisions is increased, it is necessary to accept the flicker of colors or to speed up the device. Note that, in case of speed-up of the device, there is the problem of the increase in manufacturing cost.

From the above point, the number of sub-frames should be also decided in view of the purpose of using the liquid crystal display device.

Note that, in First Embodiment through Third Embodiment disclosed has been the arrangement of the liquid crystal display device with the increased viewing angle for decreasing the gradation curve's distortion to improve the display quality level, and the explanation of the arrangement has been made.

On the other hand, the case is considered that when a mobile apparatus such as a notebook computer is used out of doors, a narrow viewing angle is effective so that other people cannot see its display screen.

Therefore, the following Fourth Embodiment explains a liquid crystal display device in which a user can adjust a desired viewing angle by increasing or decreasing the gradation curve's distortion.

[Fourth Embodiment]

The following will explain yet another embodiment of the present invention.

Figure 18:
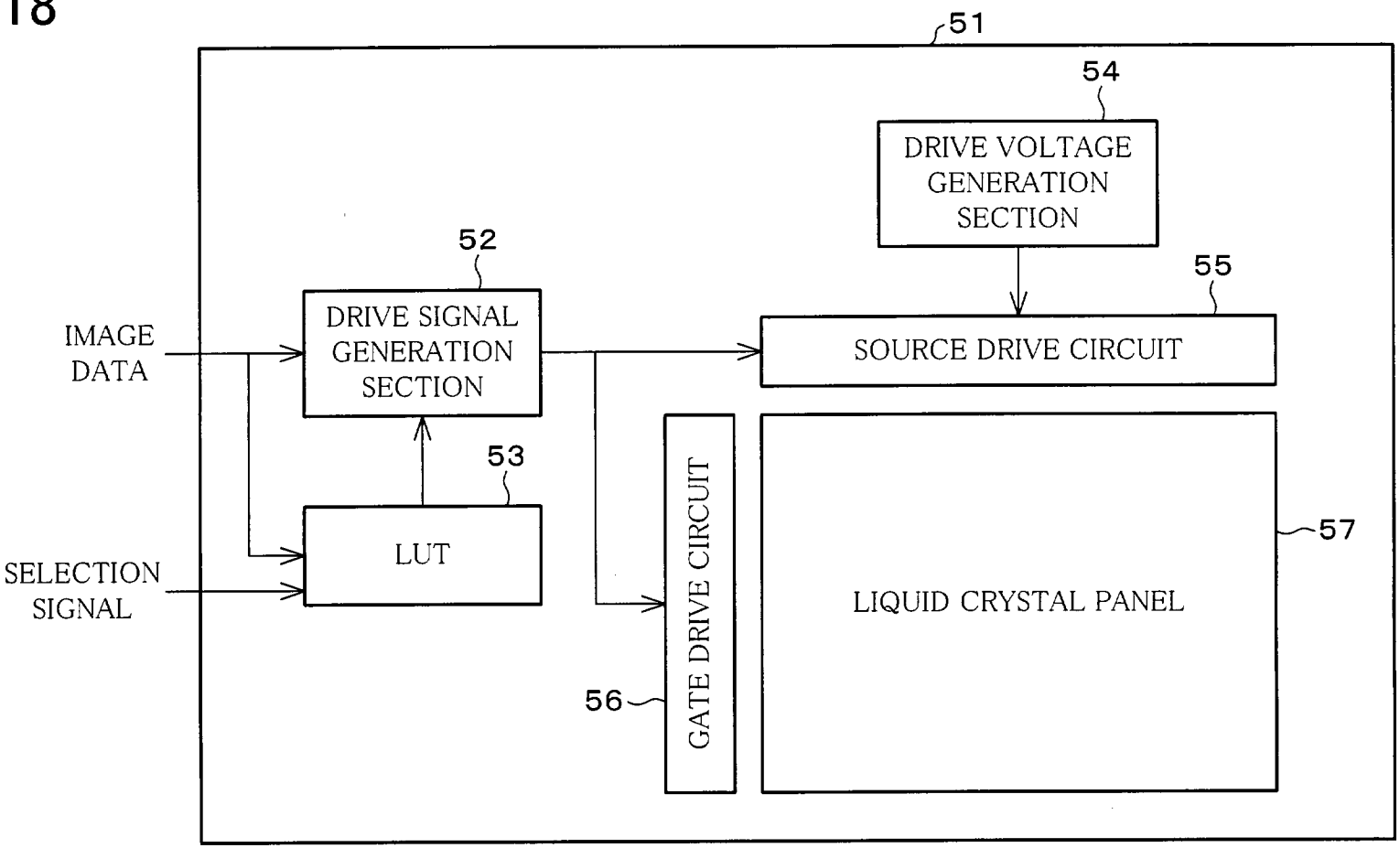
FIG. 18 is a block diagram schematically showing an arrangement of a liquid crystal display device according to yet another embodiment of the present invention.

As shown in FIG. 18, a liquid crystal display device 51 according to the present embodiment includes a drive signal generation section 52, an LUT 53, a drive voltage generation section 54, a source drive circuit 55, a gate drive circuit 56, and a liquid crystal panel 57.

The liquid crystal display device 51 has substantially the same arrangement as that of the liquid crystal display device 1 in First Embodiment; however, it is different in that plural look-up tables which can be referred are prepared in the LUT 53 so that they can be selectively referred. In the present embodiment, a selection signal is supplied to the LUT 53, and a look-up table can be selected in accordance with the selection signal.

Figure 19:
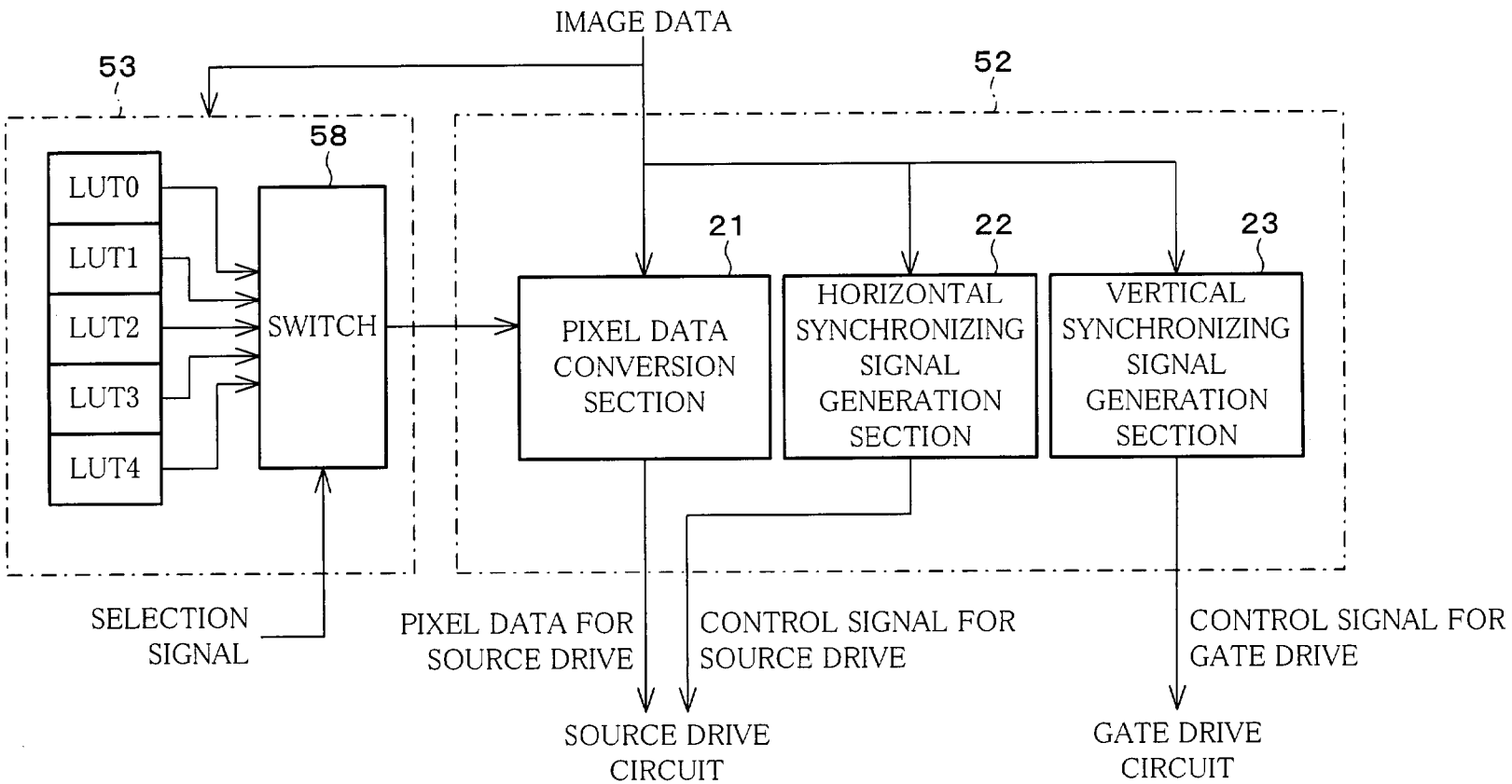
FIG. 19 is a block diagram schematically showing arrangements of a drive signal generation section and an LUT provided in the liquid crystal display device shown in FIG. 18.

As shown in FIG. 19, the drive signal generation section 52 has the same arrangement as that of the drive signal generation section 2 shown in FIG. 4 in First Embodiment. However, the LUT 53 is different from the LUT 3 described in First Embodiment in that five look-up tables (LUT 0 to LUT 4) and a switch 58 for changing these look-up tables are included.

The switch 58 selects any of the five look-up tables (LUT 0 to LUT 4) in accordance with the selection signal supplied from outside. Then, the gradation of supplied image data is set with reference to the selected look-up table.

The LUT 0 to LUT 4 are set so as to include respectively different viewing angle characteristics, so that it is possible to change the viewing angle characteristic by changing the LUTs.

Generally, in case of ASV and MVA modules, the viewing angle characteristic gets well as the color displayed actually on the screen is closer to white and black, and the viewing angle characteristic is poor at the halftone levels. Accordingly, in the case of First Embodiment, white (gradation level 255) of data and black (gradation level 0) of data are set as shown below in Table 4.

TABLE 4

| | 0 | | 255 | |
|---|---|---|---|---|
| Gradation of Pixel 8 | Gradation of Pixel A | Gradation of Pixel B | Gradation of Pixel A | Gradation of Pixel B |
| LUT 0 | 0 | 0 | 255 | 255 |
| LUT 1 | 8 | 8 | 252 | 252 |
| LUT 2 | 16 | 16 | 248 | 248 |
| LUT 3 | 24 | 24 | 244 | 244 |
| LUT 4 | 32 | 32 | 240 | 240 |

Thus, by setting the LUTs, a contrast characteristic can be changed so as to deteriorate as it goes down from the LUT 0 to LUT 4.

As to the halftone, it is set so that the gradation curve of the front is maintained to be $\gamma=2.2$, and the gradation curve of the viewing angle viewed from the side is out of $\gamma=2.2$ as it goes down from the LUT 0 to the LUT 4.

As described above, it is possible to realize the change in the viewing angle characteristic.

Here, changing mechanism of the viewing angle characteristic is explained specifically. Note that, it is assumed that the structure of the liquid crystal display device is virtually the same as that of First Embodiment, and plural, selectable LUTs are added to the structure.

Note that, it is defined that a pixel is divided into two as an arrangement condition.

The set azimuth $\phi$ is set to:

0°, 22.5°, 77.5°, 90°, 112.5°, 135°, 157.5°, 180°, 202.5°, 225°, 247.5°, 270°, 292.5°, 315°, and 337.5°.

The lowest contrast ratio in a range of viewing angle is 10.

The module for a wide viewing angle is ASV.

Central contrast ratio is 300. This is a general specification in a monitor liquid crystal module.

Adjustment is carried out at five levels.

As the viewing angle characteristic, important parameters are given below.

(A) Viewing angle characteristic of contrast (B) Viewing angle characteristic of gradation curve First, the setting of (A) viewing angle characteristic of contrast is explained.

The contrast, which is black-and-white ratio, is found out by the following equation (6):

$$\text{Contrust}(\phi, \theta) = \frac{L(\phi, \theta, 255)}{L(\phi, \theta, 0)} \tag{6}$$

Further, the central contrast ratio is 300, so that it is necessary to satisfy the following equation (7).

$$\text{Contrust}(0, 0) = \frac{L(0, 0, 255)}{L(0, 0, 0)} \geq 300 \tag{7}$$

The lowest contrast ratio in the range of viewing angle is defined to be 10, so that it is necessary to satisfy the following equation (8).

$$\text{Contrust}(\phi, \theta) = \frac{L(\phi, \theta, 255)}{L(\phi, \theta, 0)} \geq 10 \tag{8}$$

Note that, the set azimuth $\phi$ of satisfy all conditions.

Next, preparation of a table for changing five levels of viewing angle characteristics is carried out.

Figure 20:
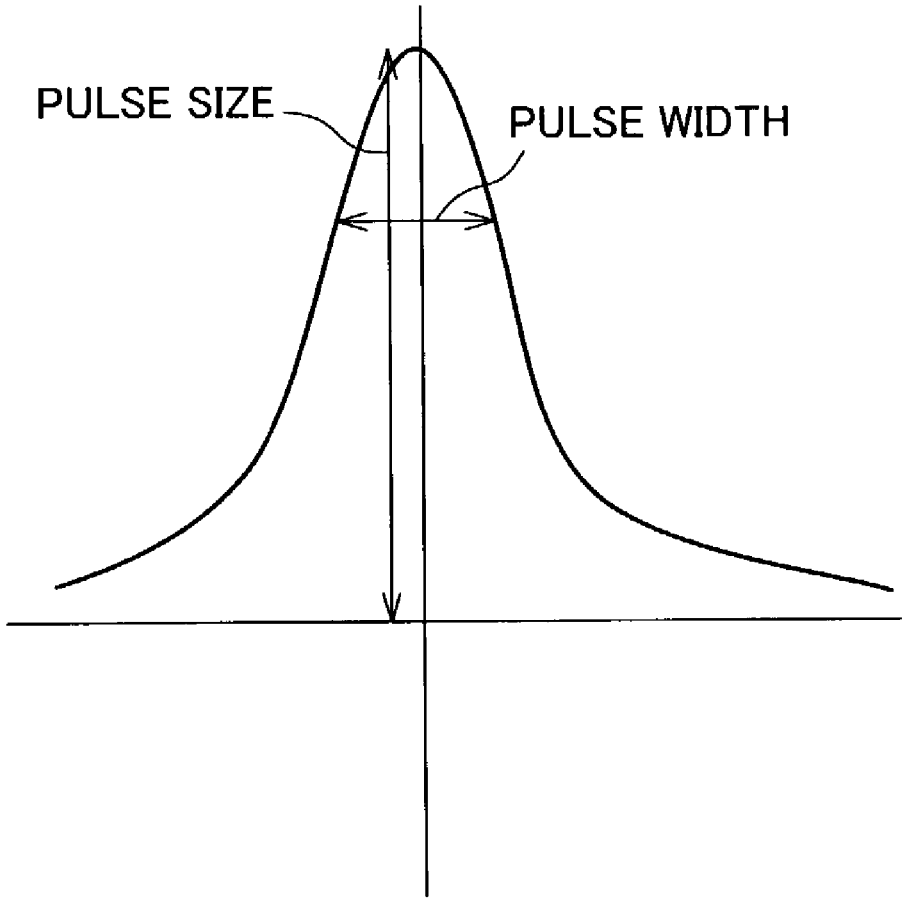
FIG. 20 is a graph showing a contrast in a liquid crystal panel.

The viewing angle characteristic of contrast varies depending on kurtosis in a graph of contrast. In a normal graph of contrast, the kurtosis is obtained by division of a pulse size by a pulse width, as shown in FIG. 20. Therefore, a large pulse with a narrow width produces a large kurtosis.

Here, the central contrast ratio is set by the following equation (9):

$$\text{Contrust}(0, 0) = \frac{L(0, 0, 255)}{L(0, 0, 0)} \cong 300 \tag{9}$$

Setting of the central contrast ratio by the equation (9) makes the pulse size constant, so that the kurtosis is decided by the pulse width. Note that, the viewing angle characteristic has also directions, and the pulse width is obtained by area.

Here, the pulse width is specified by the contrast ratio of 250, and the area of pulse width is calculated by the above equations (6), (7), and (9). The maximum value of the calculated area is Smax, and the maximum value is Smin.

Then, the areas of the pulse widths from the LUT 0 to the LUT 4 are found out as follows:

LUT 0: Smax

LUT 1: (Smax−Smin)×0.75+Smin

LUT 2: (Smax−Smin)×0.5+Smin

LUT 3: (Smax−Smin)×0.25+Smin

LUT 4: Smin

Results obtained in the above manner are given by the following Table 5.

TABLE 5

| | n = 0 | | n = 255 | |
|---|---|---|---|---|
| Pattern | $n_A$ | $n_B$ | $n_A$ | $n_B$ |
| LUT 0 | 0 | 0 | 173 | 209 |
| LUT 1 | 0 | 2 | 141 | 229 |
| LUT 2 | 0 | 7 | 196 | 202 |
| LUT 3 | 1 | 14 | 213 | 242 |
| LUT 4 | 10 | 15 | 240 | 255 |

Figure 21:
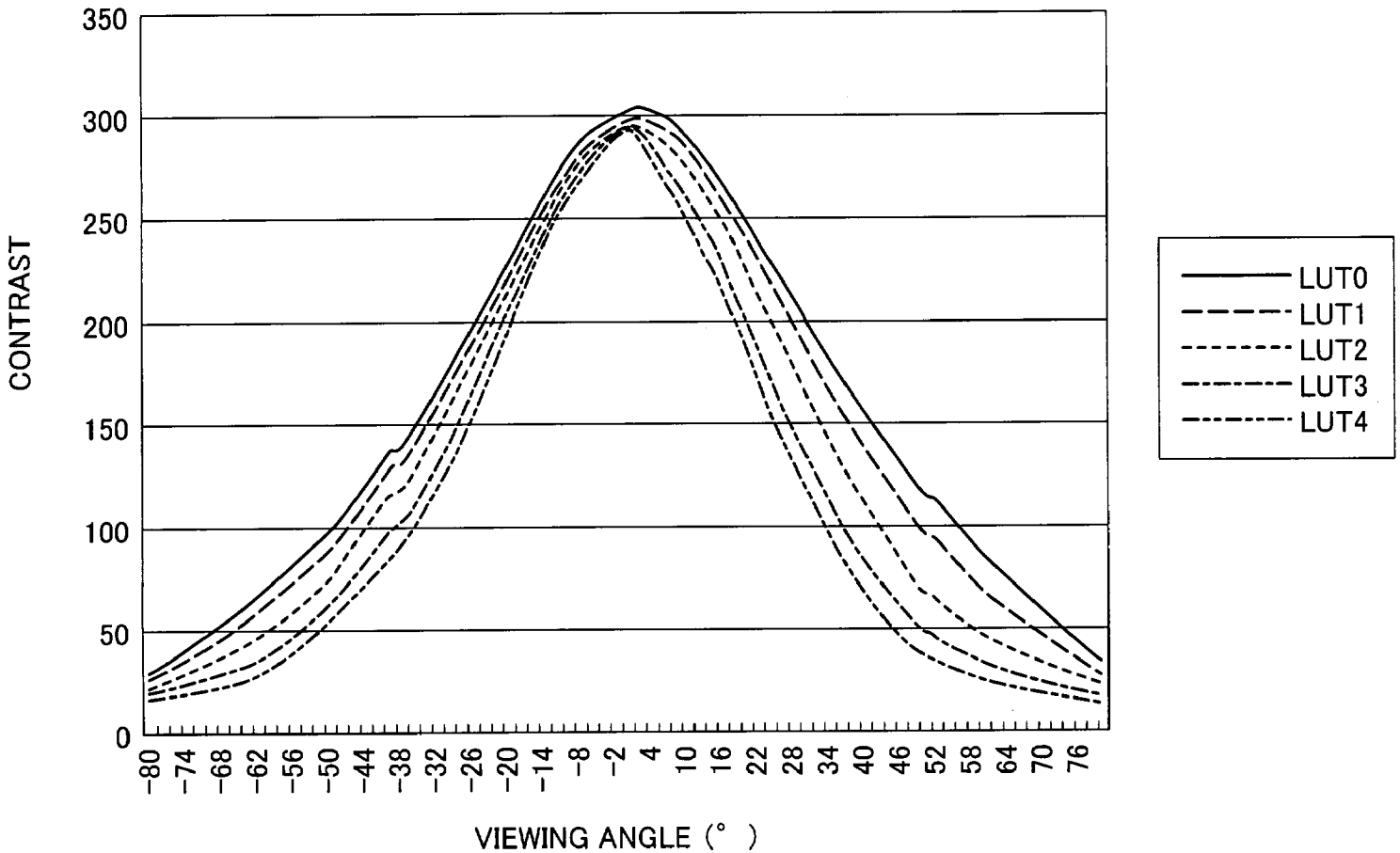
FIG. 21 is a graph showing a relation between a viewing angle and a contrast in each LUT.

FIG. 21 shows the results in Table 5 in a graph showing a relation between a contrast ratio and a viewing angle.

As seen from the graph shown in FIG. 21, the viewing angle characteristic of the contrast varies depending on the LUT while maintaining the central contrast ratio of 300. More specifically, it is apparent that the LUT 0 has the best viewing angle characteristic of the contrast, and the viewing angle characteristic of the contrast gets worse as it goes down to the LUT 4.

Secondly, (B) viewing angle characteristic of gradation curve is explained.

The gradation curve must be close to the curve of γ=2.2 in the range of viewing angle and away from γ=2.2 out of the range of viewing angle. The equation of γ=2.2 is given by the following equation (10):

$$\Gamma(2.2, \phi, \theta, n) = \left(\frac{n}{255}\right)^{2.2} * \left(\frac{L(\phi, \theta, 255) - L(\phi, \theta, 0)}{L(\phi, \theta, 255)}\right) + \left(\frac{L(\phi, \theta, 0)}{L(\phi, \theta, 255)}\right) \tag{10}$$

Note that, Γ is a numerical value normalized by 1.

Then, in case of First Embodiment, two pixels make up one pixel. Therefore, the following is the luminance of gradation n when the gradations of the two pixels are $n_A$ and $n_B$.

Here, values of $n_A$ and $n_B$ when n=0 and n=255 are the values shown in Table 5. Therefore, normalized luminance $L_{norm}$ is based on the value when n=255.

This means that a small error of the numeral value between the normalized luminance $L_{norm}$ and the equation (10) makes the gradation curve close to γ=2.2.

Consequently, the error e of the numeral value between the normalized luminance $L_{norm}$ and the equation (10) can be obtained by the following equation (11):

$$e(\phi, \theta, n) = |(L_{norm}(\phi, \theta, 0) - \Gamma(2.2, \phi, \theta, n))| \tag{11}$$

Here, change of appearance means change in kurtosis of the error's curve. Therefore, the viewing angle characteristic of the gradation curve can be set by selecting a combination of gradations by the following steps:

(1) Calculate the luminance value which is a targeted value from the contrast ratio found out in the explanation (A) of the viewing angle characteristic of the contrast.

(2) Select the combination in which the error e at the front is not more than 1% with respect to the luminance value found out at the above step (1).

(3) Find out the area of the pulse width within 10% error of the combination obtained at the above step (2).

(4) Find out the maximum area, Smax, and the minimum area, Smin, in the combination.

(5) Set five levels of areas from the areas found out at the step (4) as follows:

LUT 0: Smax

LUT 1: (Smax−Smin)×0.75+Smin

LUT 2: (Smax−Smin)×0.5+Smin

LUT 3: (Smax−Smin)×0.25+Smin

LUT 4: Smin (6) Select the combination so as to be the area found out at the step (5).

The combinations found out by the above steps are shown in the following Tables 6 to 10. Incidentally, the gradation levels 0 and 255 are also selected as the combination, so that these combinations of the gradations is different from the result obtained in the explanation regarding the viewing angle characteristic of contrast.

TABLE 6

| LUT0 | | |
|---|---|---|
| Gradation n | $n_A$ | $n_B$ |
| 0 | 0 | 0 |
| 16 | 4 | 16 |
| 32 | 0 | 33 |
| 48 | 7 | 49 |

TABLE 6-continued

| LUT0 | | |
|---|---|---|
| Gradation n | $n_A$ | $n_B$ |
| 64 | 0 | 66 |
| 80 | 7 | 82 |
| 96 | 14 | 98 |
| 112 | 4 | 115 |
| 128 | 0 | 132 |
| 144 | 0 | 148 |
| 160 | 0 | 165 |
| 176 | 0 | 181 |
| 192 | 0 | 198 |
| 208 | 4 | 215 |
| 224 | 28 | 231 |
| 240 | 57 | 244 |
| 255 | 91 | 252 |

TABLE 7

| LUT1 | | |
|---|---|---|
| Gradation n | $n_A$ | $n_B$ |
| 0 | 0 | 1 |
| 16 | 4 | 16 |
| 32 | 0 | 33 |
| 48 | 6 | 49 |
| 64 | 12 | 65 |
| 80 | 6 | 82 |
| 96 | 14 | 98 |
| 112 | 4 | 115 |
| 128 | 14 | 131 |
| 144 | 12 | 147 |
| 160 | 0 | 164 |
| 176 | 5 | 181 |
| 192 | 32 | 195 |
| 208 | 60 | 208 |
| 224 | 99 | 212 |
| 240 | 48 | 244 |
| 255 | 78 | 254 |

TABLE 8

| LUT2 | | |
|---|---|---|
| Gradation n | $n_A$ | $n_B$ |
| 0 | 0 | 7 |
| 16 | 7 | 17 |
| 32 | 22 | 28 |
| 48 | 11 | 51 |
| 64 | 19 | 67 |
| 80 | 35 | 80 |
| 96 | 30 | 100 |
| 112 | 48 | 112 |
| 128 | 32 | 135 |
| 144 | 42 | 150 |
| 160 | 32 | 170 |
| 176 | 29 | 187 |
| 192 | 59 | 199 |
| 208 | 91 | 208 |
| 224 | 135 | 205 |
| 240 | 63 | 252 |
| 255 | 110 | 254 |

TABLE 9

| LUT3 | | |
|---|---|---|
| Gradation n | $n_A$ | $n_B$ |
| 0 | 0 | 14 |
| 16 | 6 | 23 |
| 32 | 20 | 37 |
| 48 | 39 | 48 |
| 64 | 43 | 69 |
| 80 | 60 | 82 |
| 96 | 85 | 87 |
| 112 | 59 | 128 |
| 128 | 67 | 146 |
| 144 | 68 | 167 |
| 160 | 68 | 188 |
| 176 | 61 | 210 |
| 192 | 91 | 222 |
| 208 | 122 | 232 |
| 224 | 164 | 231 |
| 240 | 162 | 254 |
| 255 | 196 | 254 |

TABLE 10

| LUT4 | | |
|---|---|---|
| Gradation n | $n_A$ | $n_B$ |
| 0 | 5 | 17 |
| 16 | 18 | 21 |
| 32 | 31 | 35 |
| 48 | 38 | 56 |
| 64 | 48 | 75 |
| 80 | 74 | 83 |
| 96 | 90 | 98 |
| 112 | 105 | 114 |
| 128 | 120 | 130 |
| 144 | 134 | 147 |
| 160 | 142 | 169 |
| 176 | 162 | 181 |
| 192 | 176 | 198 |
| 208 | 190 | 215 |
| 224 | 214 | 223 |
| 240 | 208 | 254 |
| 255 | 239 | 254 |

Figure 22:
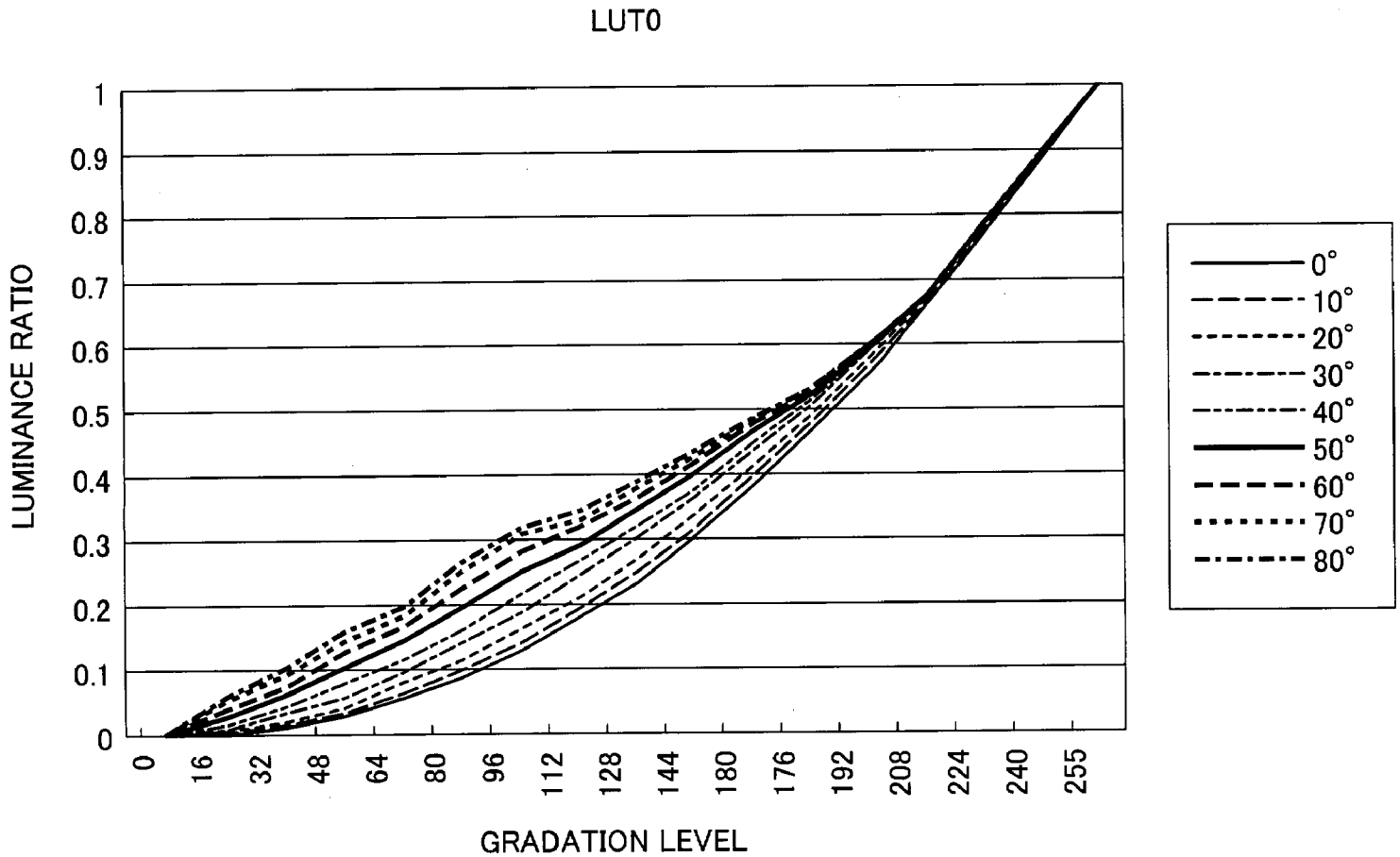
FIG. 22 is a graph showing a relation between a gradation level and a luminance ratio with respect to a liquid crystal panel in case of display using LUT 0 shown in FIG. 21.
Figure 23:
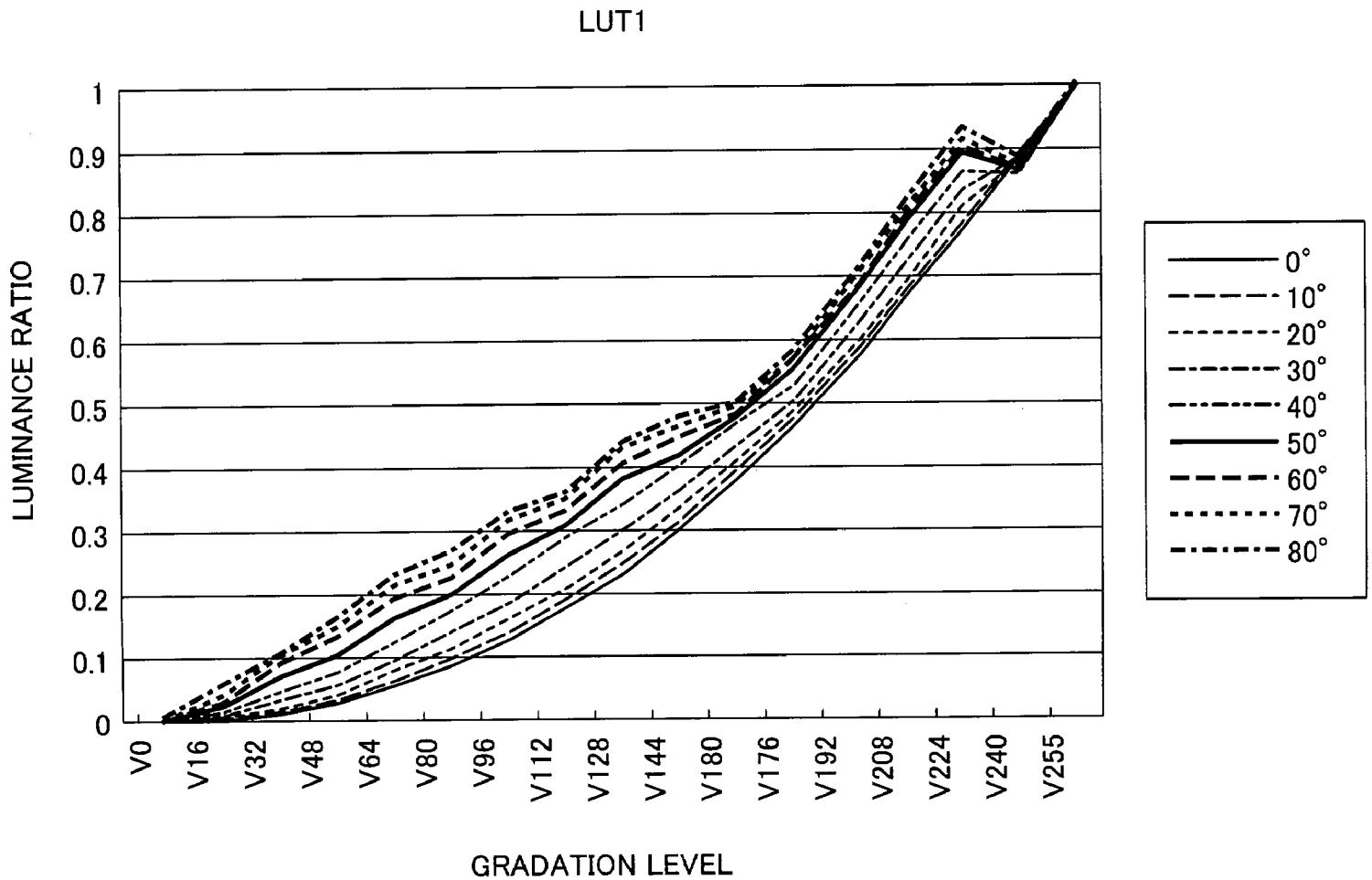
FIG. 23 is a graph showing a relation between a gradation level and a luminance ratio with respect to a liquid crystal panel in case of display using LUT 1 shown in FIG. 21.
Figure 24:
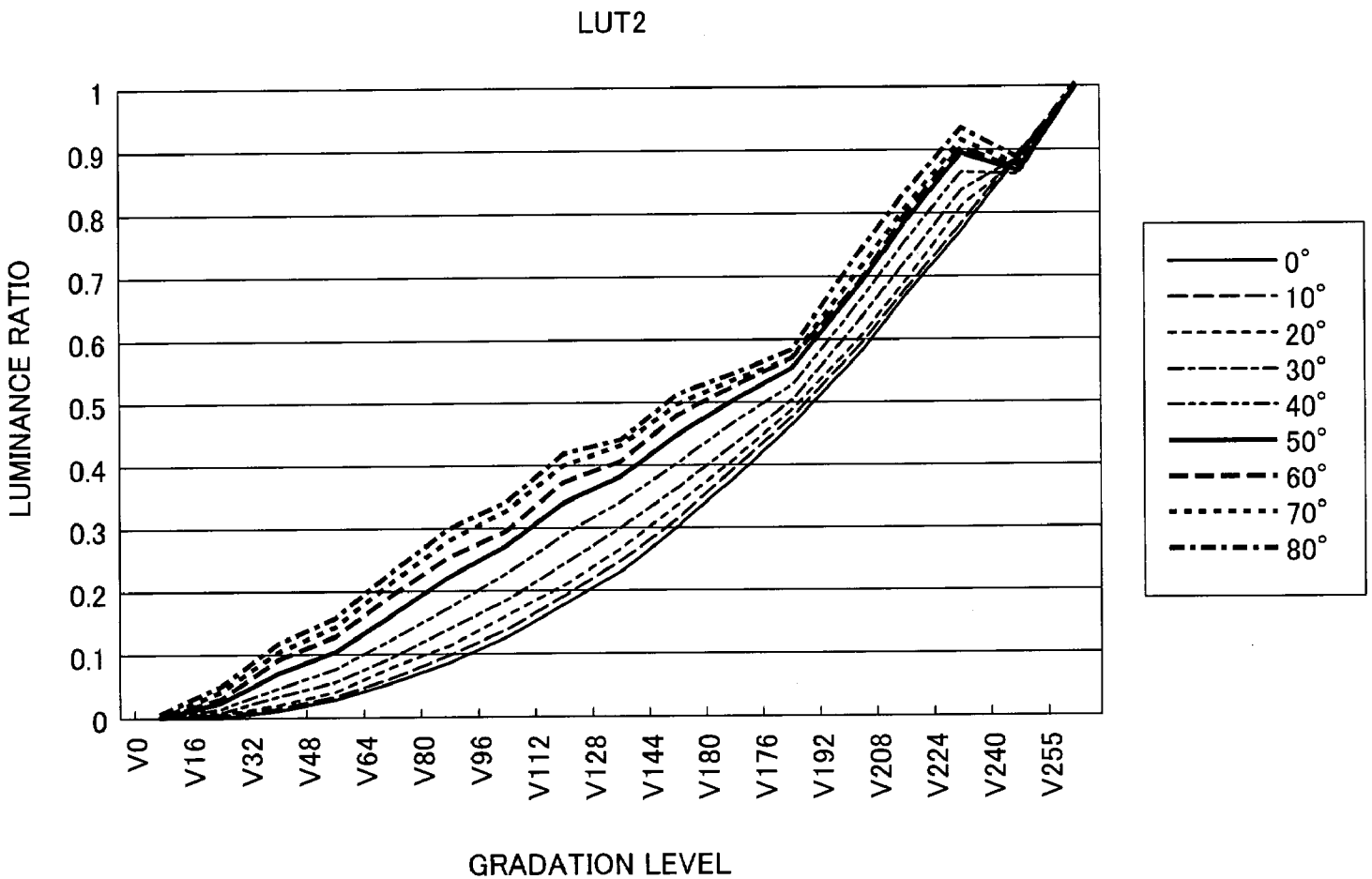
FIG. 24 is a graph showing a relation between a gradation level and a luminance ratio with respect to a liquid crystal panel in case of display using LUT 2 shown in FIG. 21.
Figure 25:
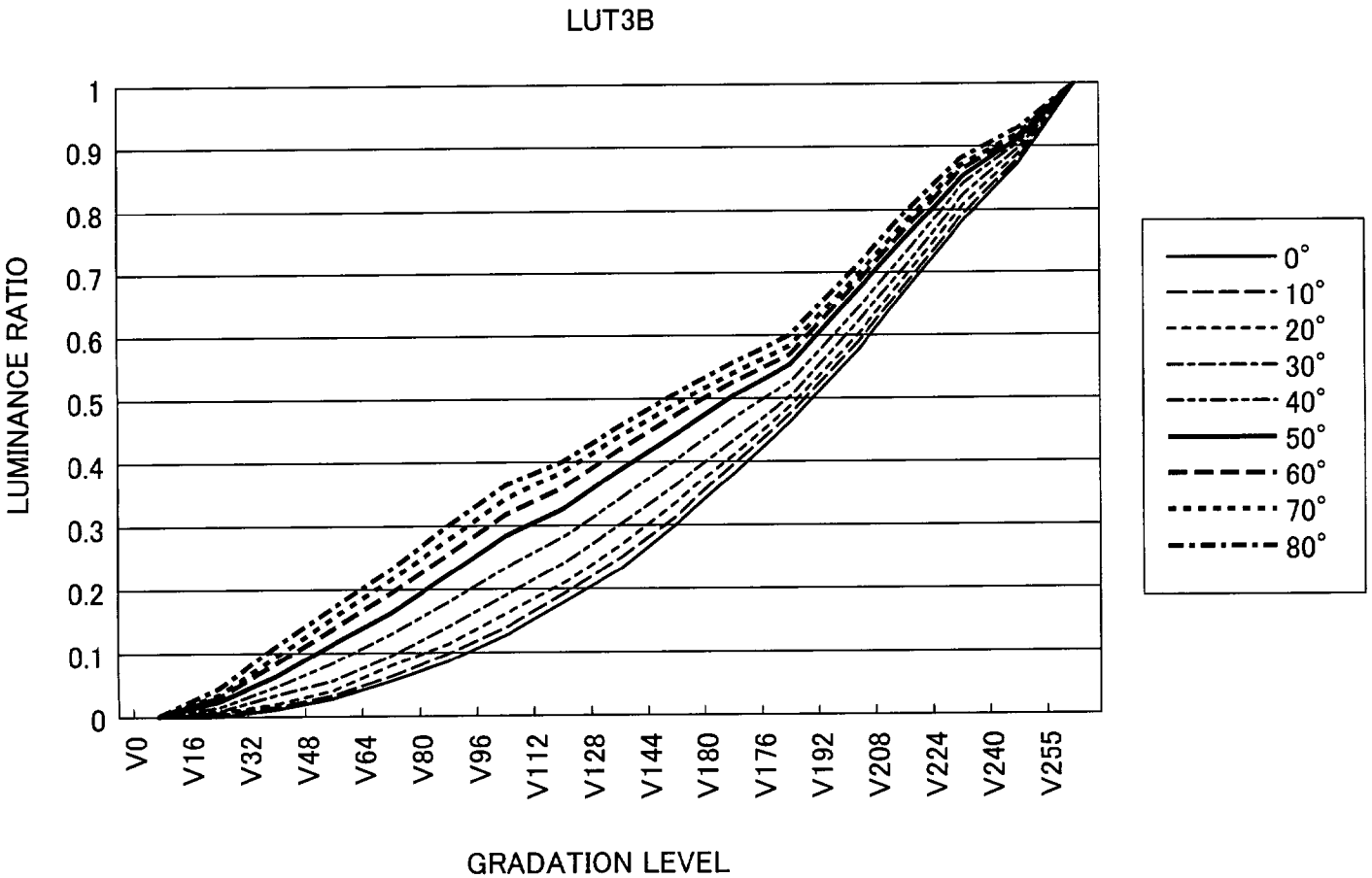
FIG. 25 is a graph showing a relation between a gradation level and a luminance ratio with respect to a liquid crystal panel in case of display using LUT 3 shown in FIG. 21.
Figure 26:
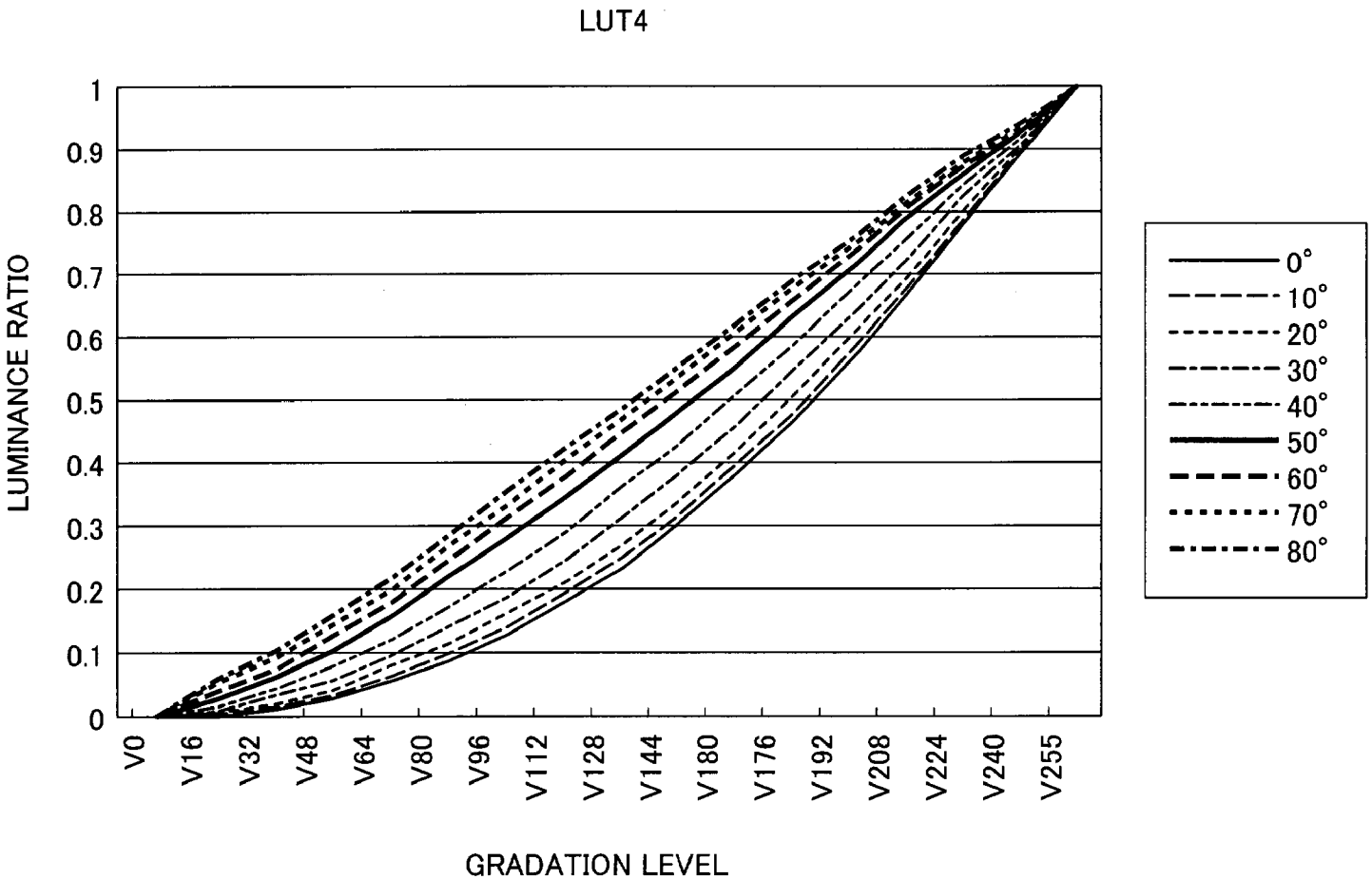
FIG. 26 is a graph showing a relation between a gradation level and a luminance ratio with respect to a liquid crystal panel in case of display using LUT 4 shown in FIG. 21.
Figure 27:
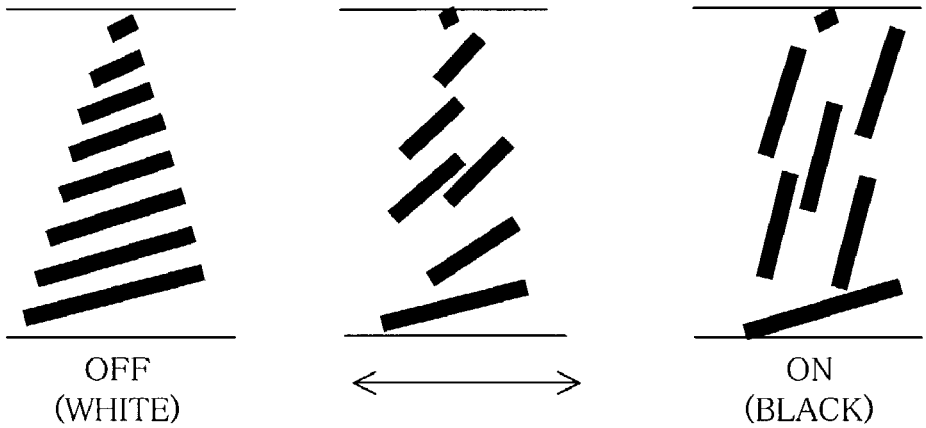
FIG. 27 is a view showing the movement of liquid crystal elements in a TN mode.
Figure 28:
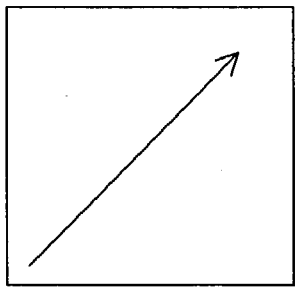
FIG. 28(*a*) is an explanatory view of a usual orientation state in case when an increased viewing angle is attempted in the TN mode, and FIG. 28(*b*) is an explanatory view of a divided orientation state in case when an increased viewing angle is attempted in the TN mode.
Figure 28:
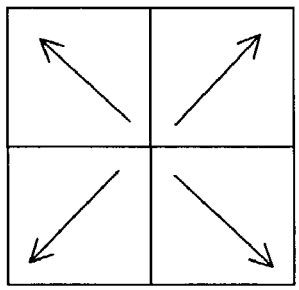
Figure 29:
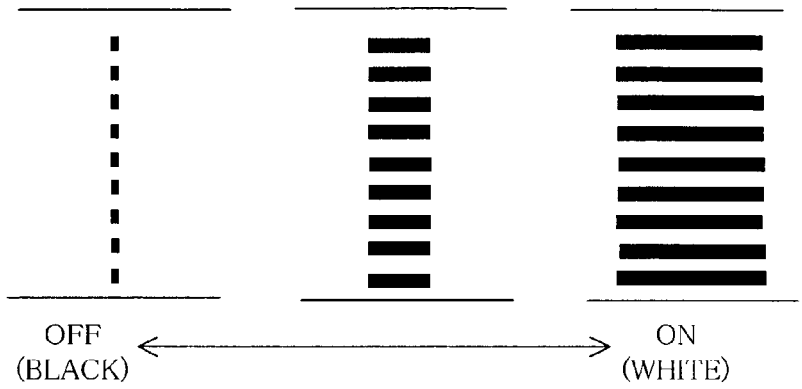
FIG. 29(*a*) is a side view of a substrate showing the movement of liquid crystal elements in an IPS mode, and FIG. 29(*b*) is a front view of a substrate showing the movement of liquid crystal elements in an IPS mode
Figure 29:
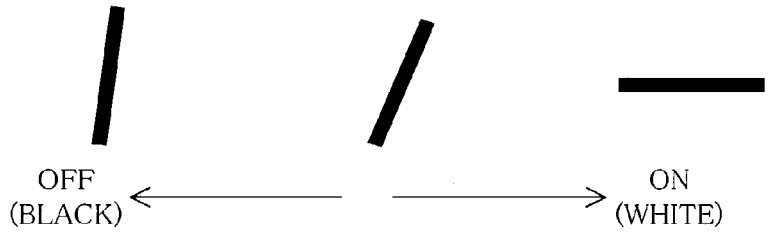
Figure 30:
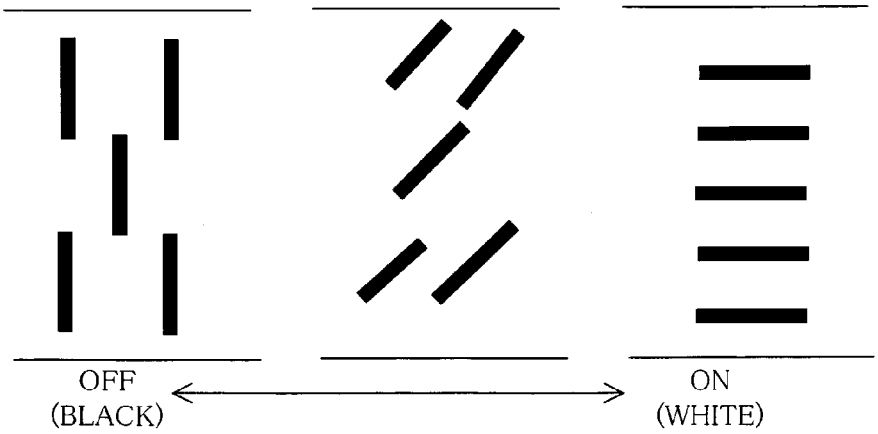
FIG. 30 is a view showing the movement of liquid crystal elements in a VA mode.
Figure 31:
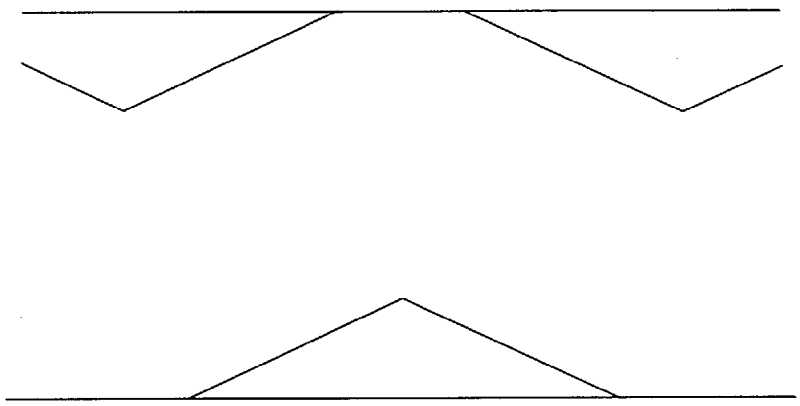
FIG. 31(*a*) is a cross sectional view schematically showing a structure of substrate surfaces in case when an increased viewing angle is attempted in the VA mode, and FIG. 31(*b*) is a view showing the movement of liquid crystal elements between the substrates having the structure shown in FIG. 31(*a*).
Figure 31:
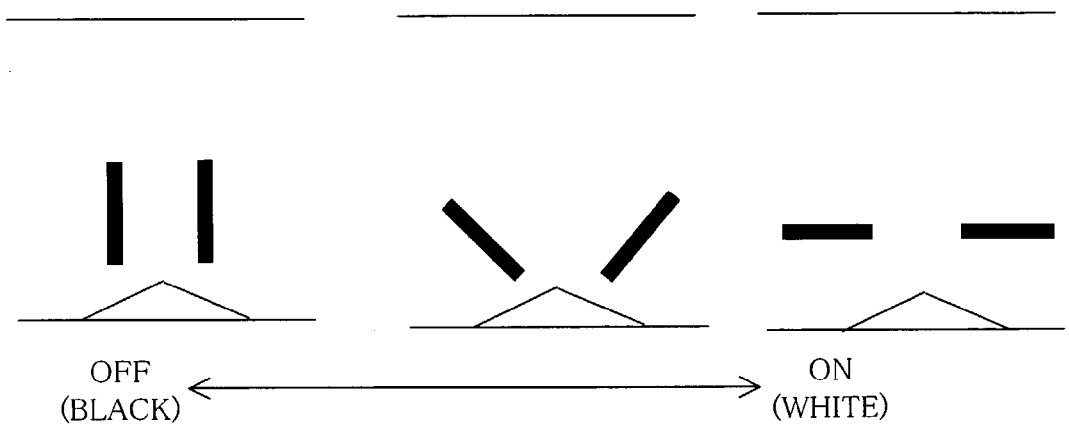

The gradation curves obtained by the LUTs are shown in FIGS. 22 to 26, respectively. More specifically, the gradation curve obtained by the LUT 0 in Table 6 is shown in the graph of FIG. 22. The gradation curve obtained by the LUT 1 in Table 7 is shown in the graph of FIG. 23. The gradation curve obtained by the LUT 2 in Table 8 is shown in the graph of FIG. 24. The gradation curve obtained by the LUT 3 in Table 9 is shown in the graph of FIG. 25. The gradation curve obtained by the LUT 4 in Table 10 is shown in the graph of FIG. 26.

Note that, the present invention is applicable to a method of electrically increasing a viewing angle as disclosed in Japanese Laid-Open Patent Publication No. 121144/1995, and it is possible to obtain combined effects by the combination with a technique of improving a contrast.

In Fifth and Sixth Embodiments mentioned later, as in the foregoing Embodiments, assumed is a liquid crystal display device which adjusts a gradation curve's distortion with respect to a viewing angle on the display screen to obtain a high contrast and an excellent gradation curve in a wide range of viewing angle, thereby improving a display quality level of a display screen; and which realizes a display screen with a narrow viewing angle, thereby allowing information not desired to be seen by other people to be securely displayed thereon. Furthermore, an example for improving the display quality level is explained.

[Fifth Embodiment]

The following will explain still another embodiment of the present invention. Note that, the liquid crystal display device according to the present embodiment has substantially the same arrangement as that of the liquid crystal display device described in First Embodiment and shown in FIG. 1; therefore, the explanation thereof is omitted.

As the liquid crystal display device described in First Embodiment and shown in FIG. 1, the liquid crystal display device according to the present embodiment includes one pixel 8 having pixel electrodes of red (R), green (G), and blue (B), each of which are divided into divisional pixels (sub-pixels) A and B. Note that, the present embodiment will be explained with reference to FIGS. 32 through 34 in which the liquid crystal panel shown in FIG. 2 is given schematically.

Figure 32:
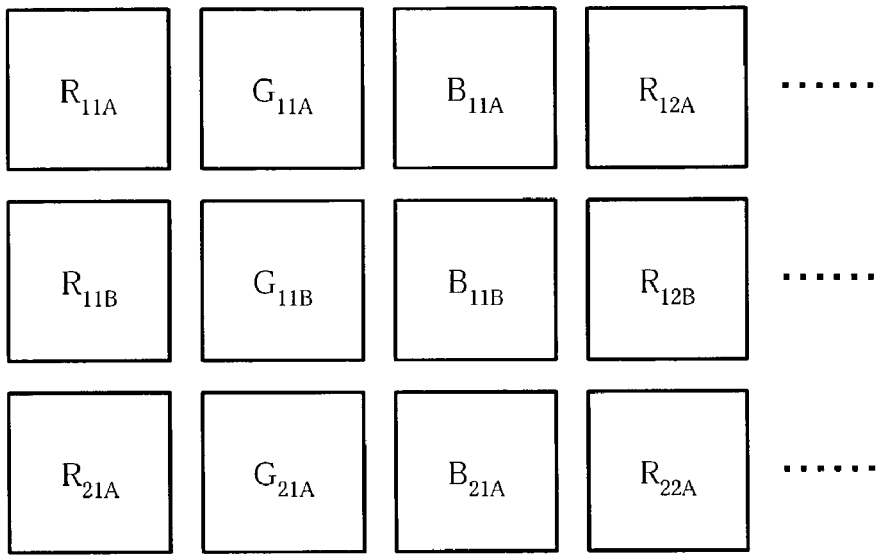
FIG. 32 is a view showing a liquid crystal panel provided in a liquid crystal display device according to still another embodiment of the present invention.
Figure 33:
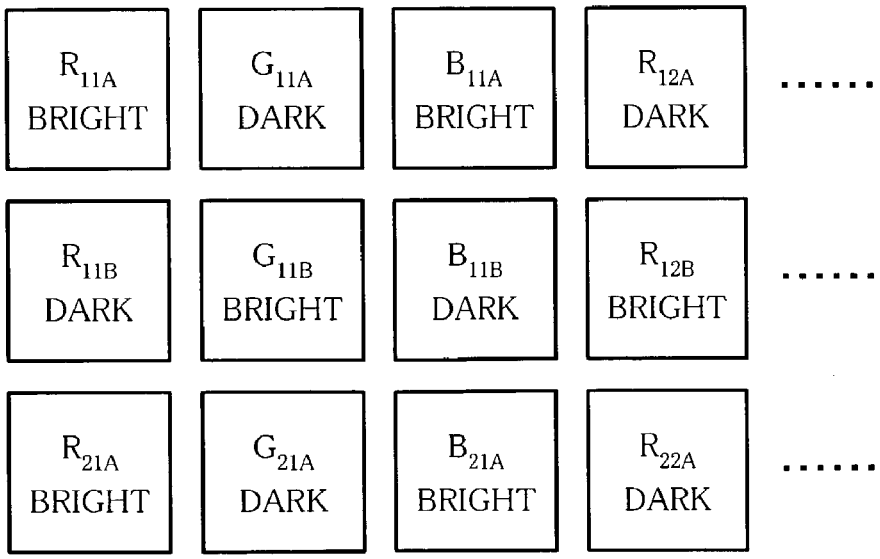
FIG. 33 is a view showing an example of displacing brightness and darkness of a luminance on sub-pixels of the liquid crystal panel shown in FIG. 32.
Figure 34:
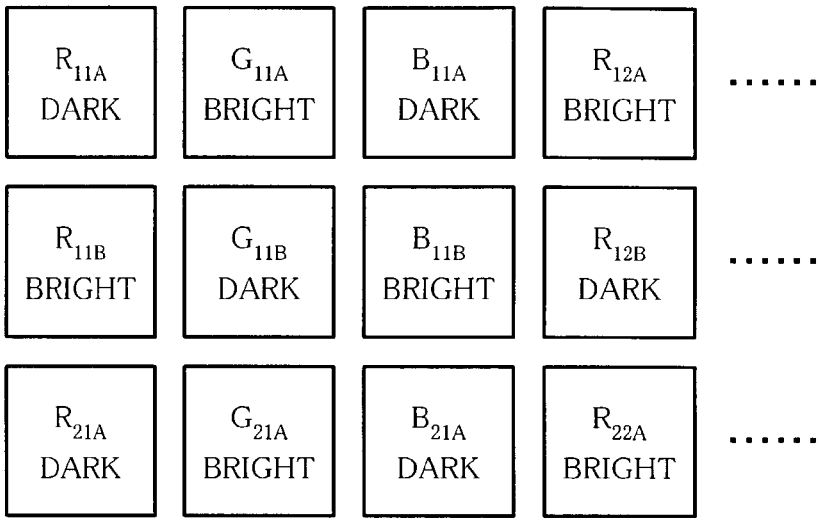
FIG. 34 is a view showing another example of displacing brightness and darkness of a luminance on sub-pixels of the liquid crystal panel shown in FIG. 32.

In FIGS. 32 through 34, a symbol Cmnd indicates a divisional pixel d (A or B) of a pixel electrode having color C(R, G, or B) of a pixel mn in the m-th row and n-th column.

Here, data of divisional pixels A and B are generated in accordance with data of a pixel mn. At this moment, data allocation to the divisional pixels A and B are carried out in accordance with the brightness and darkness of luminance. More specifically, when the each pixel's state about brightness and darkness shown in FIG. 33 is regarded as one frame, and the each pixel's state about brightness and darkness shown in FIG. 34 is regarded as one frame, data allocation to the divisional pixels A and B are carried out in such a manner that the frames shown in FIGS. 33 and 34 are alternately repeated in accordance with the brightness and darkness of luminance.

For example, stripes occur on a sigle-colored display screen when bright data are allocated onto the divisional pixels A (R11A, G11A, B11A, . . . R21A, G21A, B21A, . . . ), and dark data are allocated onto the divisional pixels B (R11B, G11B, B11B, . . . R21B, G21B, B21B, . . . ) in the state where the colored pixel electrodes are arranged on the liquid crystal panel, each including the divisional pixels A and B as shown in FIG. 32.

However, the occurrence of stripes on the sigle-colored display screen can be prevented by setting the liquid crystal panel so that data allocation to the divisional pixels A and B are repeated alternately in accordance with the brightness and darkness of luminance, and further by alternately switching the states shown in FIGS. 33 and 34 frame by frame with respect to the brightness and darkness of luminance in each divisional pixel, in the state where the colored pixel electrodes are arranged, each including the divisional pixels A and B as shown in FIG. 32.

Figure 35:
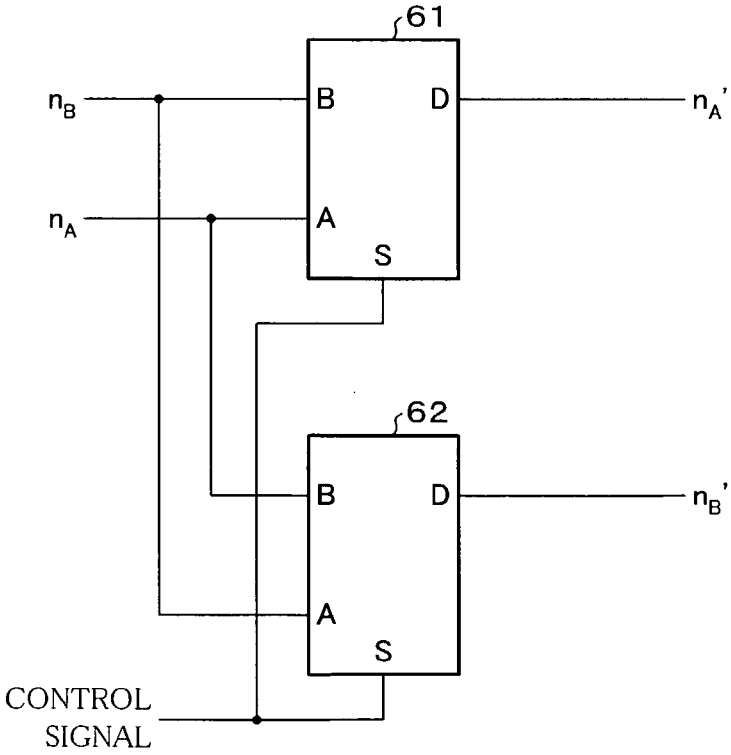
FIG. 35 is a circuit diagram showing a circuit for realizing switchover of sub-pixels each frame on the liquid crystal panel shown in FIG. 32.

Note that, the frame-by-frame switching of the divisional pixels (switching between FIGS. 33 and 34) can be realized with a simple logical circuit including two selectors 61 and 62 as shown in FIG. 35. In this circuit, when control signal is 0, output is nA'=nA and nB'=nB, and when control signal is 1, output is nA'=nB and nB'=nA. The frame-by-frame switching of the divisional pixels is possible by alternately switching the control signal between 0 and 1 frame by frame so as to be 0, 1, 0, 1, 0, 1, 0. . . .

The above logical circuit is realized in the drive signal generation section 2 of FIG. 1, explained in First Embodiment, and the control signal is also generated therein.

When generating data on sub-pixels (divisional pixels A and B), the drive signal generation section 2 generates plural patterns in accordance with display data and changes the patterns frame by frame. More actually, in the drive signal generation section 2, this can be realized by preparing plural tables for converting into sub-pixels, based on original image data, and by changing the tables frame by frame.

[Sixth Embodiment]

The following will explain still another embodiment of the present invention. Note that, the liquid crystal display device according to the present embodiment has substantially the same arrangement as that of the liquid crystal display device described in First Embodiment and shown in FIG. 1; therefore, the explanation thereof is omitted.

Generally, a liquid crystal display device performs display operation in such a manner that liquid crystal molecules are caused to move by applied electric field. Incidentally, since the liquid crystal molecules have polarities, a long applied electric field in one direction causes polarization of the liquid crystal molecules. The occurrence of polarization decreases a dynamic range of molecules' movement, resulting in the problem of the deterioration in display quality level.

Consequently, the polarity of the voltage applied to the liquid crystal is inverted frame by frame to suppress the polarization of liquid crystal, thereby preventing the deterioration in display quality level. Note that, a method for inverting the polarity of applied voltage includes a frame inversion drive system, a line inversion drive system, a dot inversion drive system, etc. and the following will explain about these methods.

The frame inversion drive system changes the polarity of voltages applied to pixels on the entire screen frame by frame.

Figure 36:
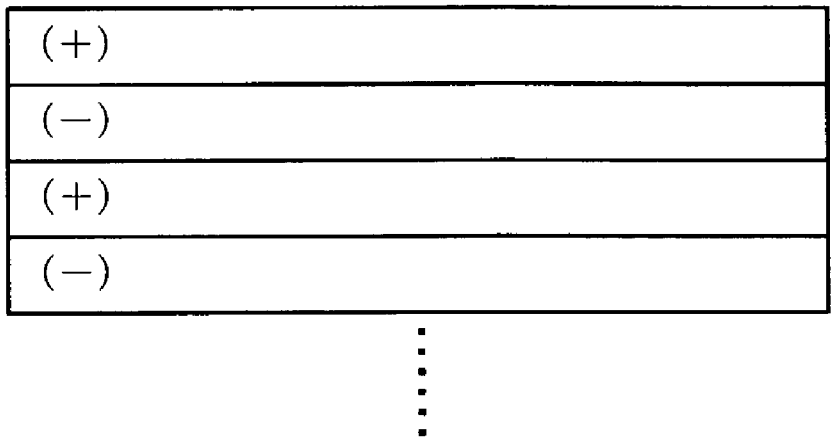
FIG. 36 is a view showing a line driving method of a liquid crystal panel.
Figure 37:
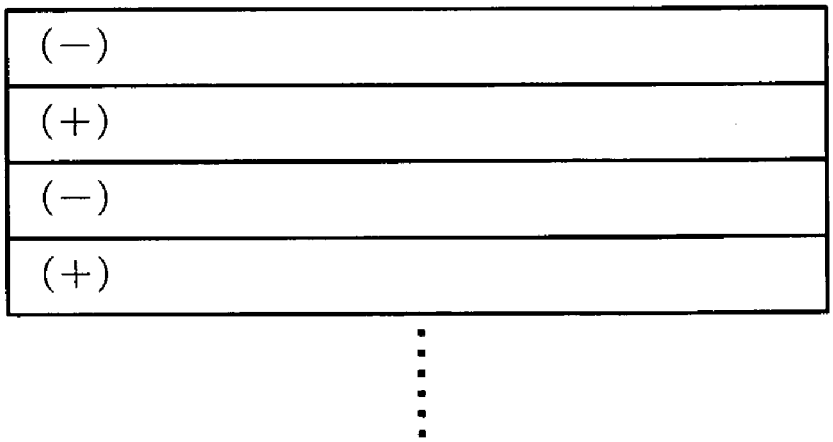
FIG. 37 is a view showing a line driving method of a liquid crystal panel.

Further, the line inversion drive system drives in such a manner that the polarity of each line is alternately inverted by switching the states shown in FIGS. 36 and 37 frame by frame. Here, in FIGS. 36 and 37, symbols "+" and "−" in the lines indicate a polarity of the applied voltage (namely, positive voltage and negative voltage). In FIG. 36, the polarity of lines is arranged in alternate order so as to be +, −, +, . . . On the other hand, in FIG. 37, the polarity of lines is arranged in opposite order of FIG. 36 so as to be −, +, −, . . .

Furthermore, the dot inversion drive system drives in such a manner that the polarity of all pixels is inverted individually.

In the present embodiment, the line inversion drive system will be explained below.

In the liquid crystal display device according to the present embodiment, as in FIGS. 33 and 34 in Fifth Embodiment, brightness and darkness of luminance are alternately reversed frame by frame with respect to the colored pixel electrodes each including the divisional pixels.

Note that, in the present embodiment, as shown in FIGS. 38 and 39, each divisional pixel has opposite polarity, and the polarity of each line is inverted frame by frame. Here, in the drawings, "bright+" indicates that the polarity of the applied voltage is positive, and it is bright one in the divisional pixels. "Dark+" indicates that the polarity of the applied voltage is positive, and it is dark one in the divisional pixels. Furthermore, "bright−" indicates that the polarity of the applied voltage is negative, and it is bright one in the divisional pixels. "Dark−" indicates that the polarity of the applied voltage is negative, and it is dark one in the divisional pixels.

Basically, the luminance of the pixel to which the positive voltage is applied is designed to be the same as that of the pixel to which the negative voltage is applied. However, the difference in luminance between them occurs due to pixel variation, etc. caused during manufacturing. For this reason, in case of the line inversion drive system, the display of a pattern including alternately arranged single-colored data at halftone and black color data looks flickering on the single-colored display screen due to the difference in luminance between the pixel to which the positive voltage is applied and the pixel to which the negative voltage is applied. This arises the problem of the deterioration in the display quality level.

To solve this problem, switching the states shown in FIGS. 38 and 39 frame by frame varies the polarity arrangement and the arrangement of brightness and darkness frame by frame, whereby a pattern easily looking flicker in a single-colored display can be complicated. This makes it difficult to cause this flicker in a usual display operation. Note that, the variation in the polarity arrangement and the arrangement of brightness and darkness can be set so that the correlation coefficient is close to 0 where the polarity arrangement and the arrangement of brightness and darkness are variables.

More specifically, the drive signal generation section 2 as the display data generating means generates a pattern on sub-pixels to decrease a degree of correlation between a pattern which is changed frame by frame and a pattern for switching of a voltage applying direction. Here, "to decrease a degree of correlation" means to decrease a mutual influence by combining the pattern which is changed frame by frame with the pattern for switching of a voltage applying direction.

The change in the polarity of the applied voltage is made by the drive voltage generation section 4 explained in First Embodiment. Note that, the polarity inversion of the applied voltage for preventing the polarization of liquid crystal elements may be carried out by the source drive circuit 5 besides the drive voltage generation section 4.

The liquid crystal display device according to the present invention may have an arrangement in which the distortion adjusting means include (a) a look-up table referred to for adjustment of the gradation curve's distortion with respect to the viewing angle and (b) display data generating means for generating display data in which the gradation curve's distortion with respect to the viewing angle is adjusted in accordance with a reference result of the look-up table.

In this case, the look-up table referred to for the adjustment of the gradation curve's distortion with respect to the viewing angle can be changed in accordance with the displaying purpose. For example, when a wide viewing angle is attempted, the look-up table is changed to a table for a wide viewing angle content (gradation curve). When a narrow viewing angle is attempted, the look-up table is changed to a table for a narrow viewing angle content (gradation curve). Therefore, the liquid crystal panel can display in accordance with the displaying contents.

As described above, in case of one displaying purpose, one look-up table may be prepared in advance. However, in case of plural kinds of displaying purposes, a plurality of look-up tables must be prepared in advance.

More specifically, the liquid crystal display device may have an arrangement in which the distortion adjusting means include (a) a plurality of look-up tables referred to for adjustment of the gradation curve's distortion with respect to the viewing angle, (b) selecting means for selecting the look-up tables, and (c) display data generating means for generating display data in purpose.

Further, increase in the number of divisions in the one pixel, i.e. increase in the number of sub-pixels constituting one pixel makes easy adjustment of the gradation on the display screen and easy improvement in the display performance.

However, it is preferable that the number of sub-pixels is decided in view of the purpose of using the liquid crystal display device because the increase in the number of sub-pixels has the following problems:

(1) the corresponding number of drive circuits is required as the number of the sub-pixels increases, and micro fabrication for the sub-pixels is also required. This results in increase in manufacturing cost of the liquid crystal display device.

(2) Increase in the number of circuits increases elements such as wires inside the liquid crystal panel, which reduces an open area ratio and transmittance, so that the additional amount of light is required for securing a luminance. This increases the power consumption of a back light, thereby increasing the cost of the back light.

Note that, in case of two sub-pixels, it is possible to incorporate the look-up table referred to for the adjustment in the gradation curve's distortion with which the gradation curve's distortion with respect to the viewing angle is adjusted in accordance with a reference result of the look-up tables.

In this case, it is possible for a user to display information with an intended gradation curve by changing, if necessary, look-up tables prepared corresponding to the number of displaying purposes. Thus, change of look-up tables makes it easy to carry out display operation in accordance with a displaying purpose.

The following is a specific means of the adjustment in the gradation curve's distortion with respect to the viewing angle by the distortion adjusting means.

The liquid crystal display device may be arranged so that one pixel in the liquid crystal panel is composed of a plurality of sub-pixels each being capable of independent drive, and the distortion adjusting means set display data supplied to the liquid crystal panel so as to show respectively different gradation curves with respect to all of the sub-pixels in the one pixel.

In this case, all of the sub-pixels constituting one pixel can show respectively different gradation curves, so that adjustment in gradations on the display screen can be easily carried out, and it is possible to easily obtain the display screen corresponding to the displaying respect to the viewing angle into a source driver of the liquid crystal panel, so that it is possible to suppress the circuit size of the liquid crystal display device.

Further, in the following description, in case of a liquid crystal display device with a liquid crystal panel carrying out color display, one pixel of the liquid crystal panel is composed of sub-pixels corresponding to three primary colors and at least one sub-pixel of a color other than three primary colors, and the distortion adjusting means may set display data supplied to the liquid crystal panel so as to show respectively different gradation curves with respect to all of the sub-pixels in the one pixel.

This case also obtains a similar effect described above as in the case of plural divisions of one pixel. More specifically, all of the sub-pixels constituting one pixel can show respectively different gradation curves, so that adjustment in gradations on the display screen can be easily carried out, and it is possible to easily obtain the display screen corresponding to the displaying purpose.

Further, increase in the number of divisions in one pixel, i.e. increase in the number of sub-pixels constituting one pixel makes easy adjustment in the gradation on the display screen and easy improvement in the display performance.

However, the increase in the number of sub-pixels is accompanied by the above problems (1) and (2). Therefore, it is preferable that the number of sub-pixels is decided in view of the purpose of using the liquid crystal display device.

Note that, in case where there is one additional sub-pixel other than the sub-pixels having three primary colors, white is provided for the additional sub-pixel. In case where there are two additional sub-pixels, green and red are preferably provided for the additional sub-pixels because contribution ratio to the luminance of green is high. Further, in case where there are three additional sub-pixels other than the sub-pixels having three primary colors, three primary colors of red, green, and blue are preferably provided for the additional sub-pixels.

Further, the display data generating means may set so that the brightness and darkness of luminance are repeated alternately with respect to the sub-pixels in one frame in accordance with display data, have patterns for generating plural kinds of data on sub-pixels which are switched between the brightness and darkness of luminance, and switch the patterns frame by frame.

More specifically, the display data generating means, when generating data on sub-pixels, may generate a plurality of patterns in accordance with the display data and change the patterns frame by frame.

In this case, data allocation to the sub-pixels is alternately repeated in accordance with the brightness and darkness of luminance, which can suppress the occurrence of recognizable repeated patterns such as stripe patterns on a single-colored display screen, thereby improving the display quality level.

In other words, repeated patterns by the sub-pixels, which causes the deterioration in the display quality level, do not appear on the screen, thereby improving the display quality level.

Furthermore, the liquid crystal display device may have a function of using a pattern on sub-pixels which is set to decrease a degree of correlation between a pattern for changing frame by frame and a pattern for switching of a voltage applying direction to prevent the polarization particular to the liquid crystal display device.

In this case, in each sub-pixel, the polarity arrangement and the arrangement of brightness and darkness varies frame by frame, so that it is possible to make the pattern easily looking a flicker complicated. This makes it difficult to cause the appearance of this flicker in a usual display operation, thereby improving the display quality level.

Further, the liquid crystal display device may be arranged so that one frame for displaying one pixel in the liquid crystal panel is composed of a plurality of sub-frames, and the distortion adjusting means set display data supplied to the liquid crystal panel so as to show respectively different gradation curves with respect to all of the sub-frames for displaying the one pixel.

In this case, as the case described above, a pixel is not composed of plural sub-pixels, but a frame for display of one pixel is composed of plural sub-frames. This uses the image persistence of human eye, and the adjustment in the number of sub-frames causes color mixture to occur for human eye.

For this reason, a simple increase in the number of sub-frames cannot increase the display performance, unlike the case of the simple increase in the number of sub-pixels. This is because the change by continuous output of the sub-frames simply increased in number just looks like the flicker of colors, not color mixture, for human eye in case where the image persistence of human eye is used as described above.

Therefore, one set of the change must be completed while the change causes the color mixture for human eye. The one set of the change in this case must occur at the frequencies from 30 Hz to 80 Hz.

Further, in case where the number of sub-frames is increased, in other words, the number of frame divisions is increased, it is necessary to accept the flicker of colors or to speed up the device. Note that, in case of speed-up of the device, there is the problem of the increase in manufacturing cost.

From the above point, the number of sub-frames should be also decided in view of the purpose of using the liquid crystal display device.

The above liquid crystal panel may be driven with a mode of a liquid crystal with a wide viewing angle for increasing a viewing angle.

In this case, setting of the gradation curve's distortion with respect to the viewing angle to be small can make the appearance of the display screen when viewed from the front the same as that when viewed from the side. Therefore, when the liquid crystal panel is driven in the mode of a liquid crystal with a wide viewing angle, it is possible to display at a wide viewing angle with a high display quality level.

Thus, as the mode of a liquid crystal with a wide viewing angle preferably used for the present invention included are IPS (In Plane Switching) mode, MVA (Multi domain Vertical Aline) mode, ASV (Advance Super View) mode, etc.

In the liquid crystal modes for increasing a viewing angle, application of the present invention can obtain high contrast and good gradation curve with a wide viewing angle.

Further, in addition to an active matrix-driven liquid crystal display device, the present invention is also applicable to, a simple matrix-driven liquid crystal display device, and a dynamic-driven liquid crystal display device if they are capable of gradation display.

Further, the present invention is not limited to each embodiments described above and susceptible of various change within the scope of the accompanying claims. An embodiment obtained by suitable combinations of technical means disclosed in the different embodiments also fall within the technical scope of the present invention.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A liquid crystal display device comprising:

a liquid crystal panel capable of gradation display, which includes distortion adjusting means for adjusting gradation curve's distortion with respect to a viewing angle, the gradation curve indicating a relation between a gradation and a luminance ratio on a display screen of the liquid crystal panel, said distortion adjusting means increasing the gradation curve's distortion with respect to viewing angle in a first mode when a narrow range of good viewing at a normalized viewing angle is desired, and decreasing the gradation curve's distortion with respect to viewing angle in a second mode when improved viewing characteristics are desired over a wide range of viewing angles;

one pixel in the liquid crystal panel is comprised of sub-pixels corresponding to three primary colors, and at least one white sub-pixel other than the three primary colors; and wherein the distortion adjusting means sets display data supplied to the liquid crystal panel so as to show respectively different gradation curves with respect to all of the sub-pixels in the one pixel.

2. The liquid crystal display device according to claim 1, wherein the distortion adjusting means include (a) a look-up table referred to for adjustment of the gradation curve's distortion with respect to the viewing angle and (b) display data generating means for generating display data in which the gradation curve's distortion with respect to the viewing angle is adjusted in accordance with a reference result of the look-up table.

3. The liquid crystal display device according to claim 2, wherein (b) the display data generating means, when generating data on sub-pixels, generate a plurality of patterns in accordance with the display data and change the patterns frame by frame.

4. The liquid crystal display device according to claim 3, wherein (b) the display data generating means generate a pattern on sub-pixels to decrease a degree of correlation between a pattern which is changed frame by frame and a pattern for switching of a voltage applying direction.

5. The liquid crystal display device according to claim 4, wherein a polarity of voltage applied to a liquid crystal is inverted frame by frame so that the voltage applying direction is switched.

6. The liquid crystal display device according to claim 1, wherein the distortion adjusting means include (a) a plurality of look-up tables referred to for adjustment of the gradation curve's distortion with respect to the viewing angle, (b) selecting means for selecting the look-up tables, and (c) display data generating means for generating display data in which the gradation curve's distortion with respect to the viewing angle is adjusted in accordance with a reference result of the look-up tables.

7. The liquid crystal display device according to claim 6, wherein (c) the display data generating means, when generating data on sub-pixels, generate a plurality of patterns in accordance with the display data and change the patterns frame by frame.

8. The liquid crystal display device according to claim 7, wherein (c) the display data generating means generate a pattern on sub-pixels to decrease a degree of correlation between a pattern which is changed frame by frame and a pattern for switching of a voltage applying direction.

9. The liquid crystal display device according to claim 1, wherein one pixel in the liquid crystal panel is composed of a plurality of sub-pixels each being capable of independent drive, and the distortion adjusting means set display data supplied to the liquid crystal panel so as to show respectively different gradation curves with respect to all of the sub-pixels in the one pixel.

10. The liquid crystal display device according to claim 1, wherein one frame for displaying one pixel in the liquid crystal panel is composed of a plurality of sub-frames, and the distortion adjusting means set display data supplied to the liquid crystal panel so as to show respectively different gradation curves with respect to all of the sub-frames for displaying the one pixel.

11. The liquid crystal display device according to claim 1, wherein the liquid crystal panel is driven with a mode of a liquid crystal with a wide viewing angle for increasing a viewing angle.

12. The liquid crystal display device according to claim 1, wherein the distortion adjusting means divide an inputted frame into sub-frames each having a half cycle of the inputted frame and output the sub-frames.

13. The liquid crystal display device according to claim 12, wherein the sub-frame is outputted continuously.

14. The liquid crystal display device according to claim 13, wherein change by continuous output of the sub-flames occurs at the frequencies from 30 Hz to 80 Hz.

15. The liquid crystal display device according to claim 1, wherein the distortion adjusting means include a logical circuit which carries out frame-by-frame switching of the sub-pixels.

16. The liquid crystal display device of claim 1, further comprising means for calculating a total sum of squared difference between a targeted value at a gradation level 0 and a combination of data at different directions and viewing angles.

17. A method of operating a liquid crystal display device, the method comprising:

providing a liquid crystal panel capable of gradation display, adjusting gradation curve's distortion with respect to a viewing angle, the gradation curve indicating a relation between a gradation and a luminance ratio on a display screen of the liquid crystal panel, increasing the gradation curve's distortion with respect to viewing angle in a first mode when a narrow range of good viewing at a normalized viewing angle is desired, and decreasing the gradation curve's distortion with respect to viewing angle in a second mode when improved viewing characteristics are desired over a wide range of viewing angles;

one pixel in the liquid crystal panel is comprised of sub-pixels corresponding to three primary colors, and at least one white sub-pixel other than the three primary colors; and wherein the distortion adjusting means sets display data supplied to the liquid crystal panel so as to show respectively different gradation curves with respect to all of the sub-pixels in the one pixel.

* * * * *